US005172107A

United States Patent [19]

Kanno et al.

[11] Patent Number: 5,172,107

[45] Date of Patent: Dec. 15, 1992

[54] DISPLAY SYSTEM INCLUDING AN ELECTRODE MATRIX PANEL FOR SCANNING ONLY SCANNING LINES ON WHICH A MOVING DISPLAY IS WRITTEN

[75] Inventors: Hideo Kanno, Kawasaki; Hiroshi Inoue, Yokohama; Atsushi Mizutome, Fujisawa, all of Japan

[73] Assignee: Canon Kabushiki Kaisha, Tokyo, Japan

[21] Appl. No.: 745,400

[22] Filed: Aug. 15, 1991

Related U.S. Application Data

[62] Division of Ser. No. 276,548, Nov. 28, 1988, Pat. No. 5,066,945.

[30] Foreign Application Priority Data

Nov. 26, 1987 [JP] Japan ..... 62-299047
Nov. 11, 1988 [JP] Japan ..... 63-285141

[51] Int. Cl.[5] ..... G09G 3/36
[52] U.S. Cl. ..... 340/784; 340/811
[58] Field of Search ..... 340/706, 709, 710, 708, 340/765, 784, 811, 721, 734; 359/84, 85; 358/230, 236

[56] References Cited

U.S. PATENT DOCUMENTS 4,367,924 1/1983 Clark et al. .
4,561,726 12/1985 Goodby et al. .
4,592,858 6/1986 Higuchi et al. .
4,596,667 6/1986 Inukai et al. .
4,613,209 9/1986 Goodby et al. .
4,614,609 9/1986 Inoue et al. .
4,642,790 2/1987 Minshull et al. ..... 340/734
4,655,561 4/1987 Kanbe et al. .
4691,200 9/1987 Stephany .
4,693,563 9/1987 Harada et al. .
4,769,762 9/1988 Tsujido ..... 340/721
4,779,085 10/1988 Mizutome et al. .
4,844,590 4/1989 Okada et al. .
4,908,710 3/1990 Wakai et al. ..... 340/784
4,964,699 10/1990 Inoue .

FOREIGN PATENT DOCUMENTS

44271/85 1/1986 Australia .
52486/86 8/1986 Australia .
13111/88 9/1988 Australia .
18929 1/1986 Japan .

*Primary Examiner*—Jeffery A. Brier
*Attorney, Agent, or Firm*—Fitzpatrick, Cella, Harper & Scinto

[57] ABSTRACT

A display apparatus includes a display panel having a display picture area formed by scanning electrodes and data electrodes arranged in a matrix. A display data storage memory stores data supplied from a display data input device. A controller controls the display data storage memory to store the moving display data. The controller also supplies address data for designating only the scanning lines corresponding to the moving display data so as to control the electrode matrix to scan only the scanning lines on which the moving display data is written.

4 Claims, 18 Drawing Sheets

DISPLAY SYSTEM INCLUDING AN ELECTRODE MATRIX PANEL FOR SCANNING ONLY SCANNING LINES ON WHICH A MOVING DISPLAY IS WRITTEN

This application is a division of application Ser. No. 07/276,548 filed Nov. 28, 1988, now U.S. Pat. No. 5,066,945.

FIELD OF THE INVENTION AND RELATED ART

The present invention relates to a display apparatus, particularly relates to a ferroelectric liquid crystal display apparatus suitable for a moving display using a cursor, mouse, etc.

For a CRT (cathode ray tube) in which an image is formed by utilizing persistence on a fluorescent screen and a TN-type LCD (twisted nematic-type liquid crystal device) and in which an image is formed by utilizing a transmittance change depending on an effective value of the driving voltage, it is necessary to use a sufficiently high frame frequency which is the frequency required for forming one picture based on this display principle. The required frame frequency is generally considered to be 30 Hz or higher. The frame frequency is expressed as the reciprocal of the product of a number of scanning lines and a horizontal scanning time for scanning each scanning line. The scanning processes or modes known at present include the interlaced scanning process (with jumping of one or more lines apart) and the non-interlaced scanning process Other practical scanning processes may include the pairing process and a process comprising simultaneous and parallel scanning of divided portions of a picture screen, while the latter process is restricted to a LCD. The NTSC standard system has adopted an interlaced scanning process comprising a 2 fields/frame and a frame frequency of 30 Hz, wherein the horizontal scanning time is about 63.5 μsec and the number of scanning lines is about 480 (for constituting an effective display area). The TN-type LCD has generally adopted a non-interlaced system including 200–400 scanning lines and a frame frequency of 30 Hz or higher. Further, for a CRT, there has been also adapted a non-interlaced scanning system using a frame frequency of 40–60 Hz and 200–1000 scanning lines.

Now, it is assumed that a CRT or TN-type LCD comprising 1920 (number of scanning lines)×2560 pixels will be driven. In the case of an interlaced system using a frame frequency of 30 Hz, the horizontal scanning time is about 17.5 μsec and the horizontal dot clock frequency is about 147 MHz (without consideration of horizontal flyback for a CRT). In the case of a CRT, the horizontal dot clock frequency of 147 MHz leads to a very high beam scanning speed which exceeds by far the maximum electron beam modulation frequency of a beam gun used in picture tubes available at present, so that accurate image formation cannot be effected even by scanning at 17.5 μsec. In the case of a TN-type LCD, driving of 1920 scanning lines corresponds to a duty factor of 1/1920 which is much lower than the minimum duty factor of about 1/4000 available at present, so that displaying fails. On the other hand, if driving at a practical horizontal scanning time is considered, the frame frequency becomes lower than 30 Hz so that the scanning state is visually observed and flickering is caused to remarkably impair the display quality. In this way, the enlargement and densification of a picture for a CRT and a TN-type LCD has been restricted so far because the number of scanning lines cannot be sufficiently increased because of the restriction resulting form the display principles and driving elements.

On the other hand, in recent years, Clark and Lagerwall have proposed a ferroelectric liquid crystal device having both a high-speed responsive characteristic and a memory characteristic (bistability).

The ferroelectric liquid crystal device shows a chiral smectic C phase (SmC*) or H phase (SmH*) in a specific temperature range, and in this state, shows a bistability, i.e., the property of assuming either a first optically stable state or a second optically stable state depending on an applied electric field and retaining the resultant state in the absence of an electric field applied thereto. Further, the ferroelectric liquid crystal device shows a quick response to a change in the electric field and is therefore expected to be widely used as a display device of a high speed and memory-type.

However, it is generally difficult for such a ferroelectric liquid crystal device to show an ideal bistability as proposed by Clark et al but it is liable to show a monostability. Clark et al used an alignment control method, such as application of a shearing force by relative movement or application of a magnetic field in order to realize a permanent bistability. From the viewpoint of production technique, however, it is advantageous to apply uniaxial orientation treatment, such as rubbing or oblique vapor deposition to a substrate. Such a uniaxial orientation treatment applied to a substrate for alignment control has sometimes failed to provide a permanent bistability. In the resultant alignment state failing to provide a permanent bistability, i.e., a so-called monostable alignment state, a biaxial orientation state formed under application of electric fields tends to be transformed into a uniaxial orientation state under no electric field in a period ranging from several milliseconds to several hours. For this reason, a display apparatus using such a ferroelectric liquid crystal device showing monostability an image formed under application of electric fields in accordance with the removal of the electric fields. Particularly in a multiplexing drive, there has been observed the problem that written states in pixels on non-addressed scanning lines are gradually lost.

In order to solve such a problem, there has been proposed a driving scheme (refreshing drive scheme) wherein pixels on a selected scanning line are selectively supplied with a voltage for providing "black" or a voltage for providing "white", the scanning lines are sequentially selected in a cycle of one frame or one field, and the cycle is repeated for writing. Such a refreshing drive scheme provides very little fluctuation in transmittance and has obviated difficulties, such as visual recognition of a writing scanning line (where a higher luminance than the other lines can be easily recognized) and the occurrence of flickering under a frame frequency lower than 30 Hz. According to our study, a similar effect has been confirmed even under a low frequency as low as about 5 Hz.

The above facts can be effectively utilized to solve altogether the problems of enlargement and densification of the picture arising from the above-mentioned essential requirement of a CRT and TN-type LCD that a frame frequency of 30 Hz or higher is required for driving.

However, such a low-frequency refreshing drive as described above is too slow for so-called motion picture display, such as smooth scrolling or cursor movement in character compiling or on a graphic display, thus resulting in deterioration of display performance. In recent years, there have been remarkable developments in computers, peripheral circuits thereof and softwares therefor. For example, for a large picture and high density display, there has been developed a display scheme called a multi-window display scheme, wherein a plurality of pictures are displayed in superposition in a display area. A display apparatus incorporating a ferroelectric liquid crystal device is one which can afford to provide enlargement and densification of a picture area which exceeds by far those realized by conventional display apparatus, such as a CRT and TN-type LCD. In accordance with such enlargement and densification, there arise problems that the frame frequency is lowered, and the velocity of smooth scrolling and cursor movement is lowered even further.

SUMMARY OF THE INVENTION

An object of the present invention is to provide a display apparatus having solved the above-described problems, particularly to provide a display apparatus capable of a high-speed cursor movement and mouse movement under a scanning drive at a low frame frequency as low as 30 Hz or below.

According to a principle aspect of the present invention, there is provided a display apparatus, comprising:

(a) a display panel having a display picture area formed by scanning electrodes and data electrodes arranged in a matrix;

(b) drive means including a first means for driving the scanning electrodes and a second means for driving the data electrodes; and (c) control means for controlling the drive means so as to repeat a partial rewriting scanning drive comprising applying an scanning selection signal to only a part of the scanning electrodes forming the display picture area.

According to a second aspect of the present invention, there is provided a display apparatus, comprising:

(a) a display panel having a display picture area formed by scanning electrodes and data electrodes arranged in a matrix;

(b) drive means including a first means for driving the scanning electrodes and a second means for driving the data electrodes; and (c) control means for controlling the drive means so as to scan-select the scanning electrodes with jumping of one or more scanning electrodes apart for one vertical scanning drive of the scanning electrodes constituting the whole picture area and scan-select the scanning electrodes without jumping for scanning drive of only a part of the scanning electrodes constituting the whole picture area.

According to a third aspect of the present invention, there is provided a display apparatus comprising:

(a) a display panel having a display picture area formed by scanning electrodes and data electrodes arranged in a matrix;

(b) drive means including a first means for driving the scanning electrodes and a second means for driving the data electrodes; and (c) control means for controlling the drive means so as to scan-select the scanning electrodes with jumping of two or more scanning electrodes apart in one vertical scanning and scan-select non-adjacent scanning electrodes in at least two consecutive times of vertical scanning for scanning drive of the scanning electrodes constituting the whole picture area, and scan-select the scanning electrodes without jumping for scanning drive of only a part of the scanning electrodes constituting the whole picture area.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A. Signal Transfer Scheme

Figure 1:
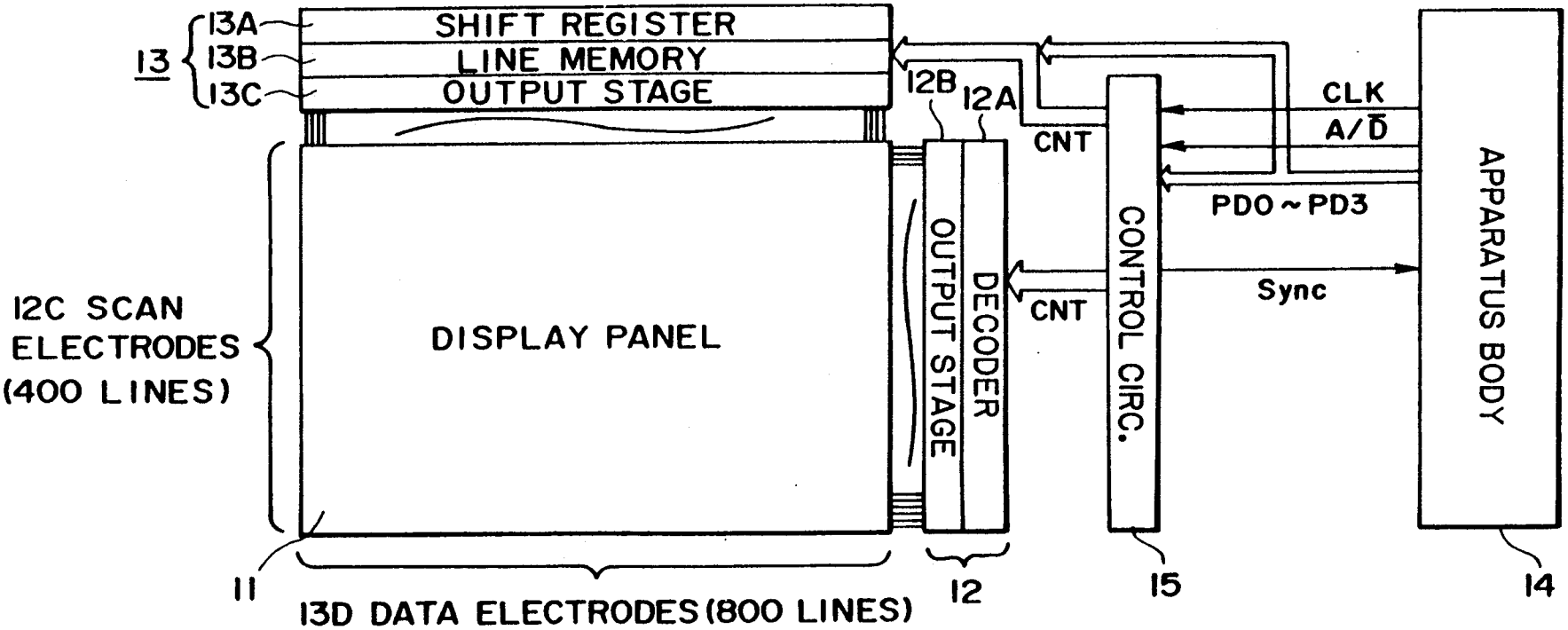
FIG. 1 is a block diagram of a display apparatus according to the invention.

FIG. 1 is a block diagram of a display apparatus according to the present invention showing an arrangement of a liquid crystal display apparatus and an apparatus body for supplying display data signals.

A display panel 11 comprises a matrix electrode structure composed of 400 scanning electrodes 12C and 800 data electrodes 13D between which a ferroelectric liquid crystal is disposed. The scanning electrodes 13D are connected to a scanning electrode drive circuit 12 and the data electrode 12D are connected to a data electrode drive circuit 13. The scanning electrode drive circuit 12 is provided with a decoder 12A and an output stage 12B. The data electrode drive circuit 13 is provided with a shift register 13A, a line memory 13B and an output stage 13C.

First of all, scanning electrode address data for addressing scanning electrodes 12C and image data are supplied from an apparatus body 14 to a control circuit through four signal lines PD0, PD1, PD2 and PD3. In this embodiment, scanning electrode address data (A0, A1, A2, ..., A11) and image data (D0, D1, D2, D3, ..., D798, D799) are transferred respectively through the same transmission signal lines PD0–PD4, so that it is necessary to differentiate the scanning electrode address data and the image data. In this embodiment, a discriminating signal A/D− is used. The A/D− signal at a high level means scanning electrode address data, and the A/D− signal at a low level means image data. The A/D− signal also contains a transfer-initiation signal for transfer of display data.

When scanning electrode address data are supplied to the scanning electrode drive circuit 12 and image data are supplied to the data electrode drive circuit 13, the scanning electrode address data A0–A11 and the image data D0–D799 are serially supplied through the signal lines PD0–PD3. It is necessary to provide a circuit for distributing the scanning electrode address data A0–A11 and the image data D0–D799 or extracting the scanning electrode address data A0–A11. This operation is performed by the control circuit 15. The control circuit 15 extracts the scanning electrode address data A0–A11 supplied through the signal lines PD0–PD3, temporarily stores the data and supplies the data to the scanning electrode drive circuit 12 in a horizontal scanning period for driving a designated scanning electrode 12C. The scanning electrode address data A0–A11 are supplied to the decoder 12A in the scanning electrode drive circuit 12 and a scanning electrode 12C is selected through the decoder 12A.

On the other hand, the image data D0–D799 are supplied to the shift register 13A in the data electrode drive circuit 13 and are separated into image data D0–D799 for pixels corresponding to the data electrodes 13D (800 lines) while being shifted for 4 pixels each by transfer clock signals CLK. When a shifting operation of the data for one horizontal scanning line is completed by the shift register 13, 800 bits of the image data D0–D799 in the shift register 13 are transferred to the line memory 13B and are stored therein in a horizontal scanning period. Further, in this embodiment, the drive of the display panel 11 and the generation of the scanning electrode address data A0–A11 and image data D0–D799 in the apparatus body 14 are not synchronized, so that it is necessary to synchronize the control circuit 15 and the apparatus body 14 at the time of display data transfer. For this purpose, a synchronizing signal Sync is generated in the control circuit for each horizontal scanning.

Figure 2:
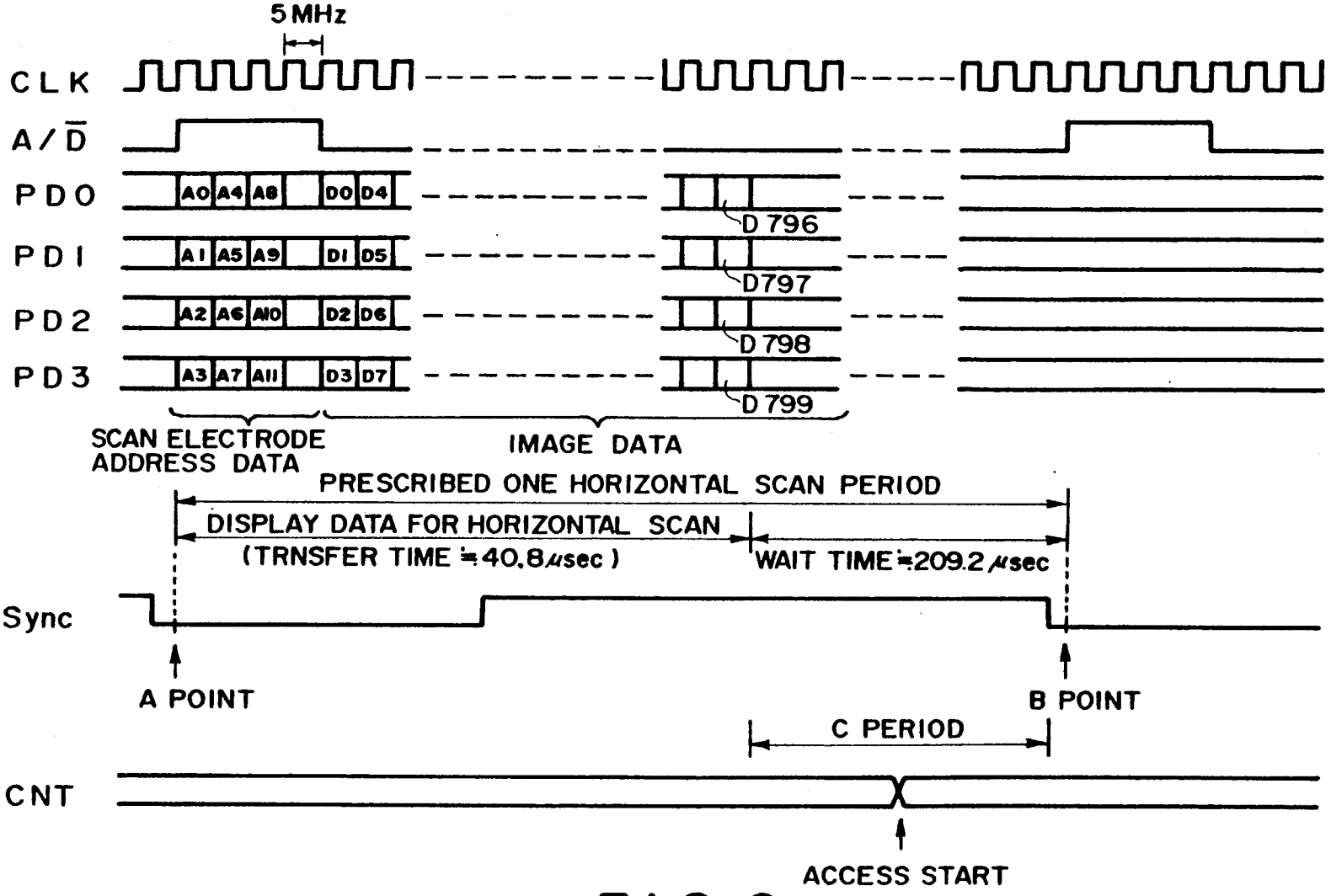
FIG. 2 is a time chart showing time correlation between signal transfer and driving.

The signal Sync is associated with the signal A/D−. The apparatus body 14 always watches the signal Sync to transfer display data when the signal Sync is LOW and does not effect transfer after transfer of data for one horizontal scanning when the signal Sync is HIGH. More specifically, referring to FIG. 2, at an instant when the signal Sync is turned LOW, the A/D− signal is turned HIGH at a point A and then the control circuit 15 returns the Sync signal to HIGH during the display data transfer period. Then, at a point B which is one horizontal scanning period counted from the point A, the Sync signal is returned to LOW. If the apparatus body 14 successively transfers display data at the point B, i.e., if a subsequent scanning electrode is driven, the A/D− signal is again turned HIGH to start the transfer. A refresh drive or a whole display picture (area) scanning drive is performed in this embodiment, so that the drive is continuously effected line-sequentially.

The above-mentioned one horizontal scanning period (corresponding to one scanning selection period) is prescribed depending on the characteristic of the ferroelectric liquid crystal and the driving method in consideration also of optimum driving conditions. In this embodiment, the one horizontal scanning period was set to about 250 μsec at room temperature so that the frame frequency was about 10 Hz. Further, the transfer clock CLK frequency was 5 MHz, and the transfer time of the scanning electrode address data and image data was about 40.8 μsec, and the waiting time shown in FIG. 2 was 209.2 μsec. The control signal CNT is a control signal for generating a desired driving waveform. This is supplied from the control circuit 15 to the respective drive circuits 12 and 13. The time for outputting the CNT is the same as the time for outputting the scanning electrode address data A0–A11 from the control circuit 15 to the scanning electrode drive circuit 12 and also the same as the time for transferring the image data in the shift register 13A to the line memory 13B.

The time for outputting the CNT signal is switched at a point which is after the completion of the transfer time (40.8 μsec) from the low level-starting point (A point) of the Sync signal and one horizontal scanning period counted from the access starting point for the previous line. In this embodiment, a C period set between the termination of the transfer time and the point (B) of a subsequent signal turning low is determined as constant.

The above communication is effect between the drive circuits 12 and 13, and also between the apparatus body 14 and the control circuit 15, and the display panel is driven according to the above time-sequence.

B. Display Scanning Scheme

In the present invention, a refreshing drive is performed by an interlaced scanning (jump-scanning) scheme as described below and a partial rewriting drive is performed by a non-interlaced scanning (non-jump-scanning) scheme.

1. Refreshing or Whole Display (Area) Scanning Drive

A scanning selection signal is sequentially applied to the scanning electrodes with jumping of N lines apart ($N \geqq 1$, preferably $4 \leqq N \leqq 20$), on one vertical scanning period (corresponding to one field period), and one picture scanning (corresponding to one frame scanning) is effected by $N+1$ times of field scanning. In the present invention, it is particularly preferred that one vertical scanning is effected two or more scanning electrodes apart and scanning electrodes not adjacent to each other are selected (scanned) in at least two consecutive times of vertical scanning.

Figure 3A:
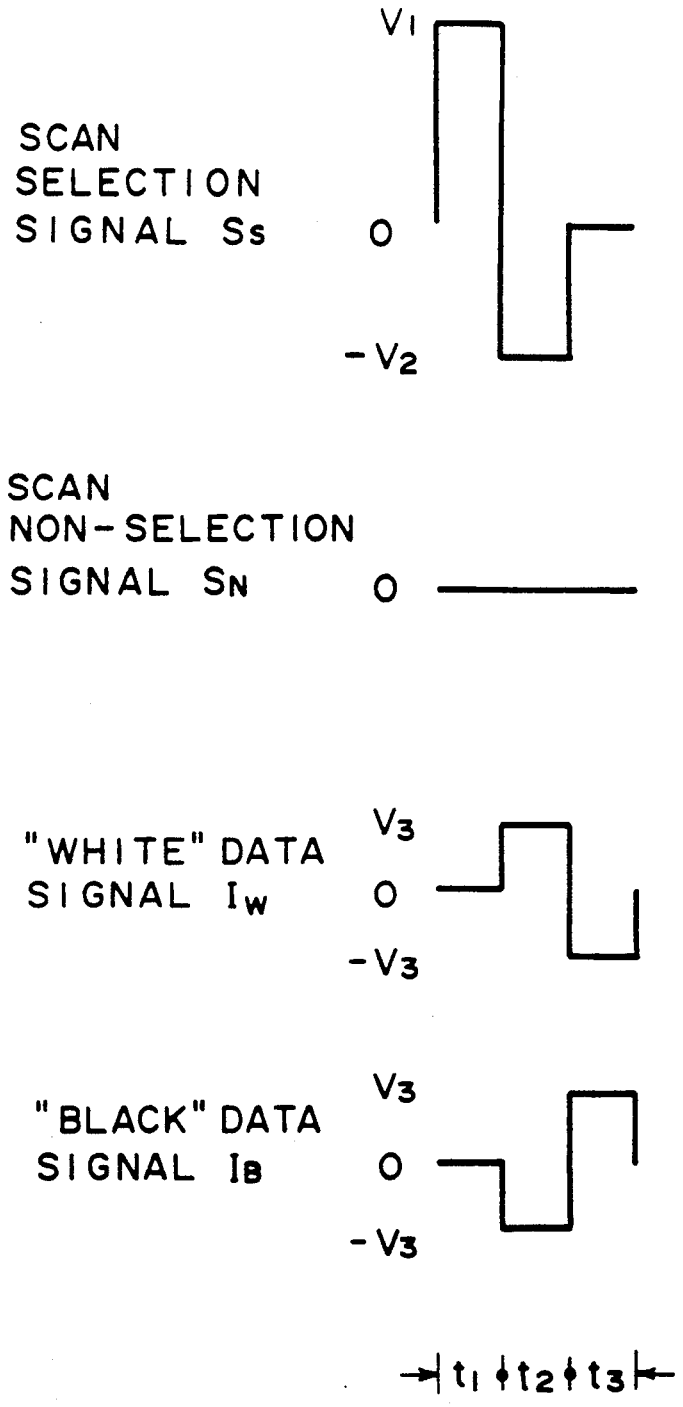
FIGS. 3A–3D respectively show a set of driving signal waveforms used in the invention.
Figure 3B:
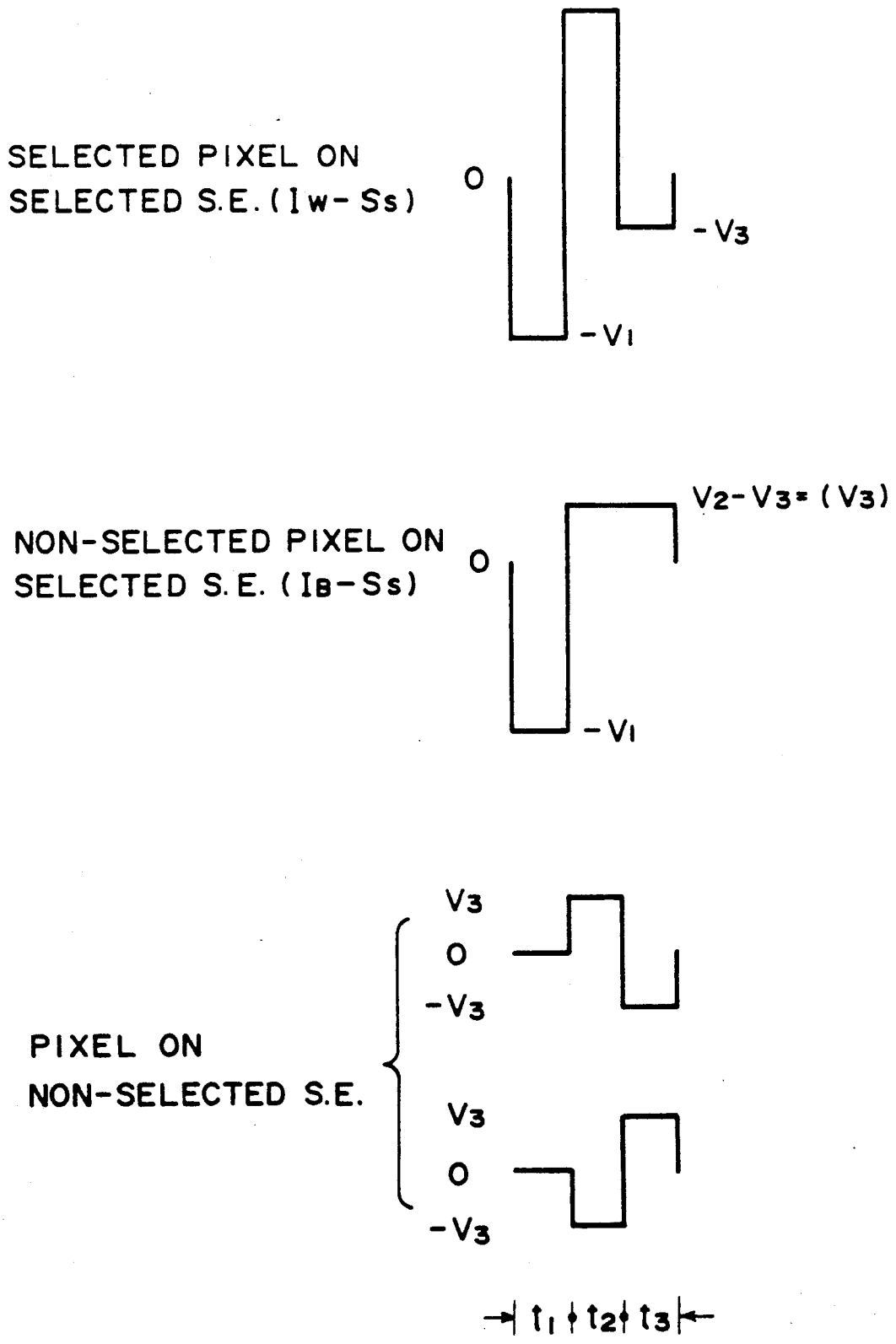

FIG. 3A shows a scanning selection signal $S_S$, a scanning non-selection signal $S_N$, a white data signal $I_W$ and a black data signal $I_B$. FIG. 3B shows a voltage waveform applied to a selected pixel among the pixels on a selected scanning electrode receiving a scanning selection signal (a voltage ($I_W - S_S$) applied to a pixel receiving a white data signal $I_W$), a voltage waveform applied to a non-selected pixel on the same selected scanning electrode (a voltage ($I_B - S_S$) applied to a pixel receiving a black data signal $I_B$), and voltage waveforms applied to two types of pixels on a non-selected scanning electrode receiving a scanning non-selection signal. According to FIGS. 3A and 3B, the pixels on a selected scanning electrode are simultaneously supplied with a voltage providing one orientation state of a ferroelectric liquid crystal to be erased into a black state based on such one orientation state of the ferroelectric liquid crystal (a pair of cross nicol polarizers are so arranged as to effect erasure into a black state in this embodiment, but it is also possible to arrange polarizers so as to cause erasure into a white state) in phase $t_1$ regardless of the kind of a data signal supplied. In a subsequent phase $t_2$, a selected pixel on the selected scanning electrode ($I_W-S_S$) is supplied with a voltage ($V_2+V_3$) providing a white state based on the other orientation state of the ferroelectric liquid crystal, and the other pixels on the selected scanning electrode ($I_B-S_S$) are supplied with a voltage ($V_2-V_3=V_3$)not changing the black state formed in the phase $t_1$. On the other hand, the pixels on a scanning electrode receiving the scanning non-selection signal are supplied with voltages $\pm V_3$ below the threshold voltage of the ferroelectric liquid crystal. As a result, in this embodiment, the pixels on the selected scanning electrode are written into either black or white through phases $t_1$ and $t_2$ and retain their states even when they are subsequently supplied with a scanning non-selection signal $S_N$.

Further, in this embodiment, in a phase t3, a voltage of a polarity opposite to that of the data signal in the writing phase $t_2$ is supplied from a data electrode. As a result, a pixel at the time of scanning non-selection is supplied with an AC voltage to improve the threshold characteristic of the ferroelectric liquid crystal. Such a signal applied through a data electrode is called an auxiliary signal and is explained in detail in U.S. Pat. No. 4,655,561.

Figure 3C:
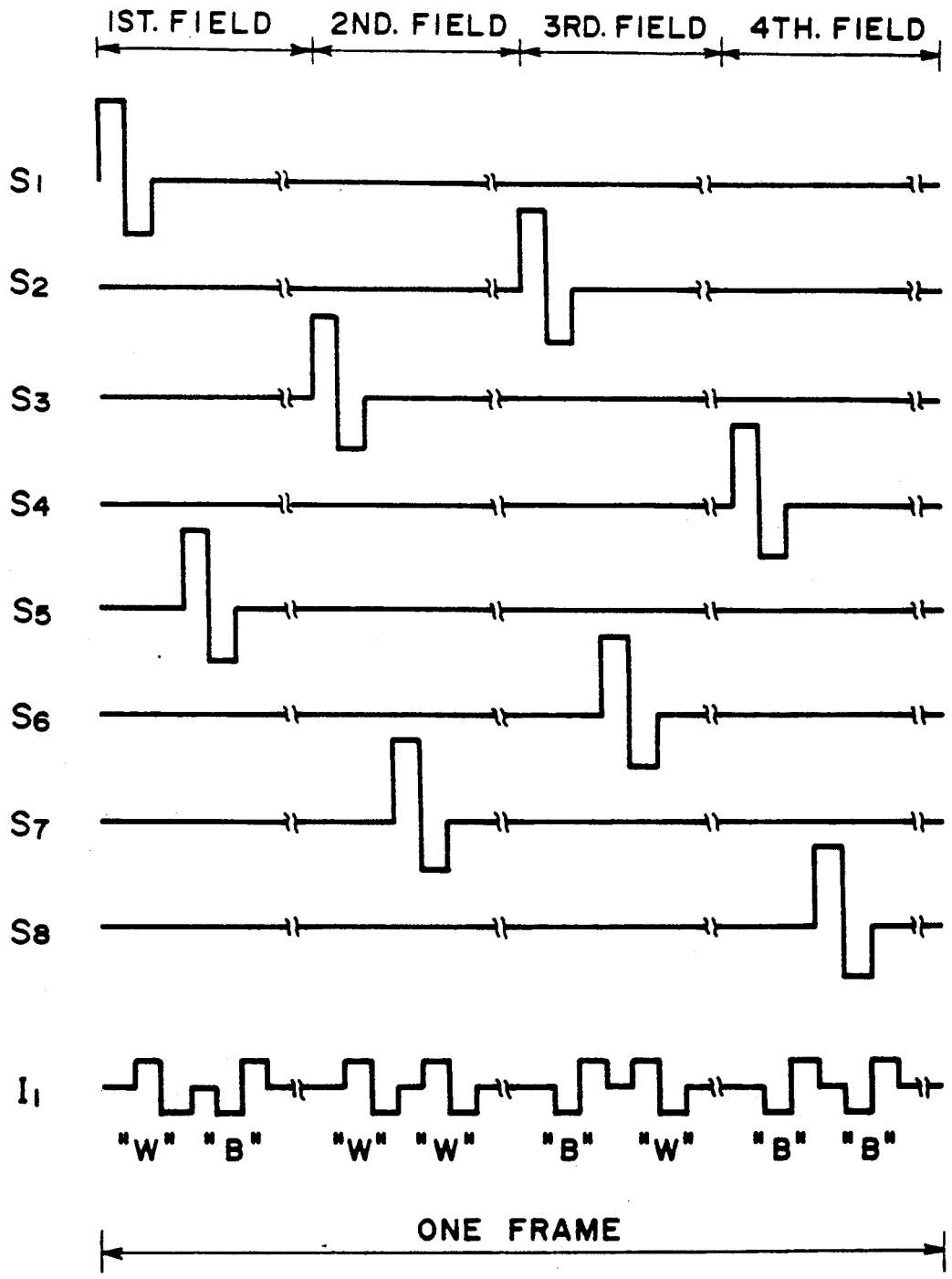

FIG. 3C is a time chart of voltage waveforms for providing a certain display state. In this embodiment, a scanning selection signal is applied to the scanning electrodes three lines apart in one field, and one frame scanning (one picture scanning) is effected by 4 consecutive times of field scanning so that no adjacent pair of scanning electrodes are supplied with a scanning selection signal together in 4 consecutive fields. As a result, a scanning selection period ($t_1+t_2+t_3$) can be set longer as required at a low temperature, so that the occurrence of flickering attributable to a scanning drive at a low frame frequency can be remarkably suppressed even at such a low frame frequency as 5–10 Hz, for example. Further, by applying a scanning selection signal so that non-adjacent scanning electrodes are selected in consecutive four field scannings, the image flow problem can be effectively solved.

Figure 3D:
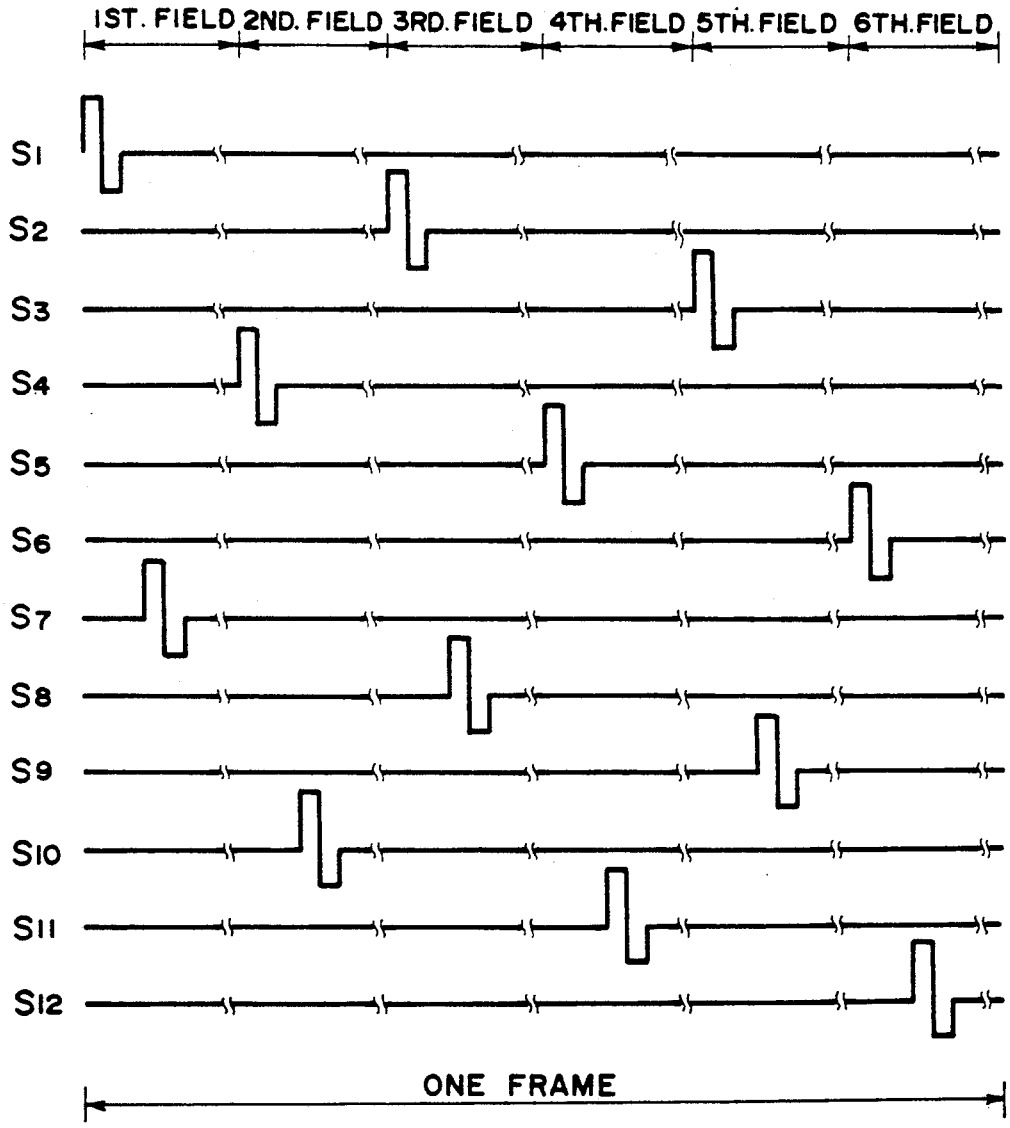

FIG. 3D shows an embodiment using driving waveforms shown in FIG. 3A. In this embodiment, the scanning electrodes are selected 5 lines (scanning electrodes) apart so that non-adjacent scanning electrodes are selected in 6 times of consecutive field scanning.

Figure 4A:
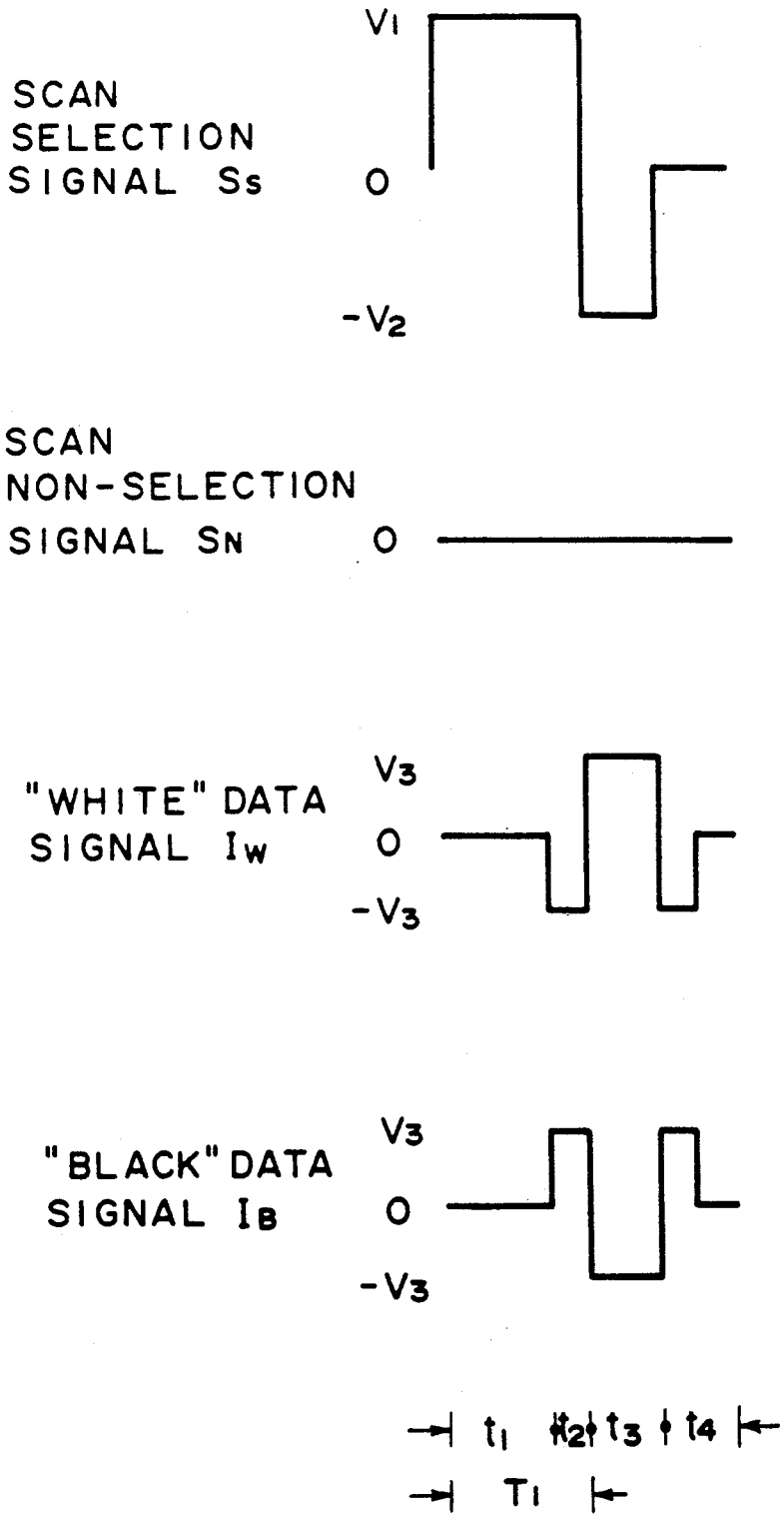
FIGS. 4A–4C respectively show a set of driving signal waveforms used in the invention.
Figure 4B:
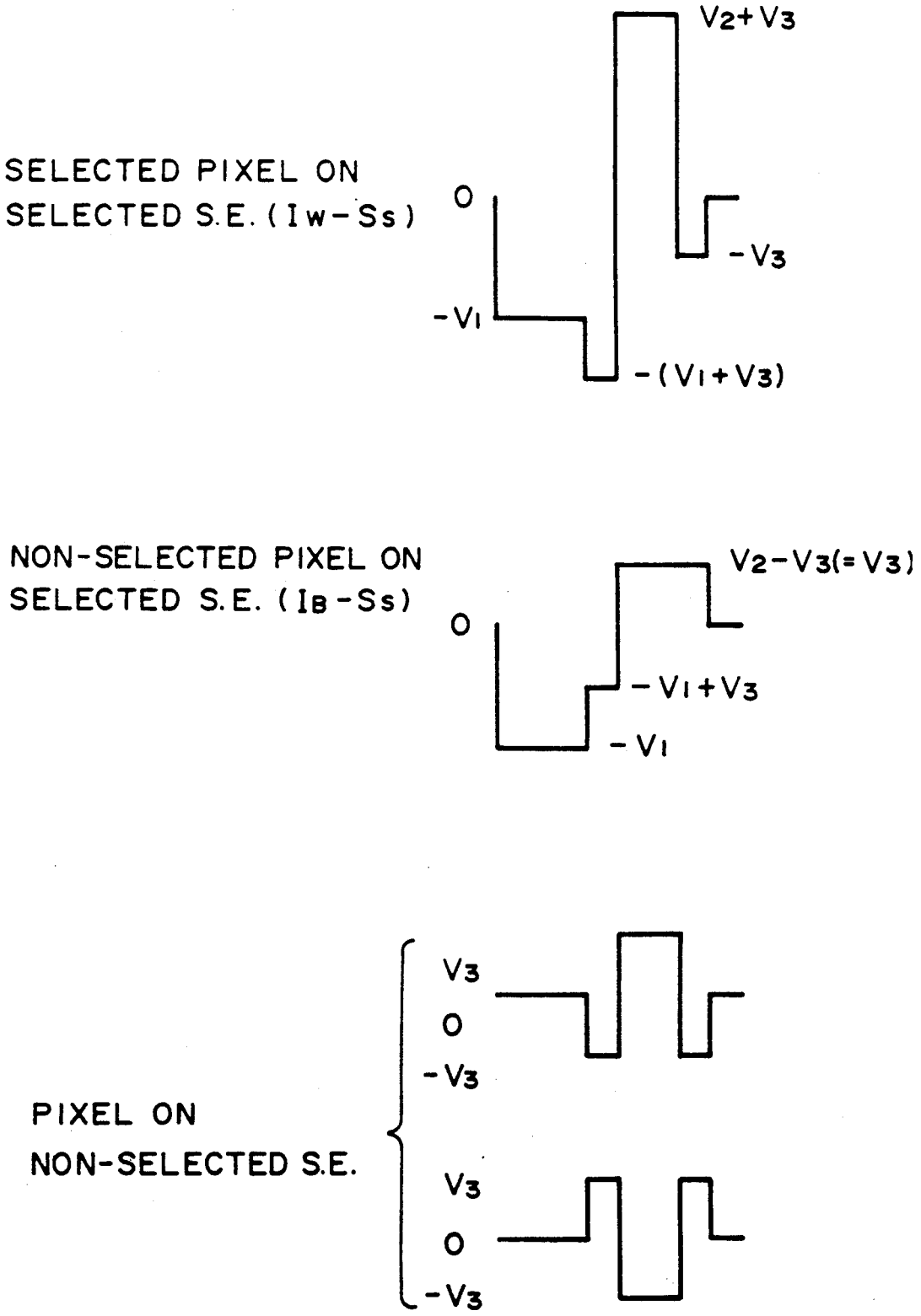

FIGS. 4A and 4B show another driving embodiment used in the present invention.

According to FIGS. 4A and 4B, on a scanning electrode receiving a scanning selection signal $S_S$, all or a prescribed part of the pixels are simultaneously supplied with a voltage for erasure into a black state in phase $T_1(=t_1+t_2)$ regardless of the types of data signals, and in phase $t_3$, a selected pixel ($I_W-S_S$) is supplied with a voltage ($V_2+V_3$) for inversion writing into a white state and the other pixels ($I_B-S_S$) are supplied with a voltage ($V_2-V_3=V_3$) not changing the black state formed in the phase $T_1$. Further, phases $t_2$ and $t_4$ are provided for applying auxiliary signals so as to apply an AC voltage to the pixels at the time of non-selection, similar to the previous embodiment.

Figure 4C:
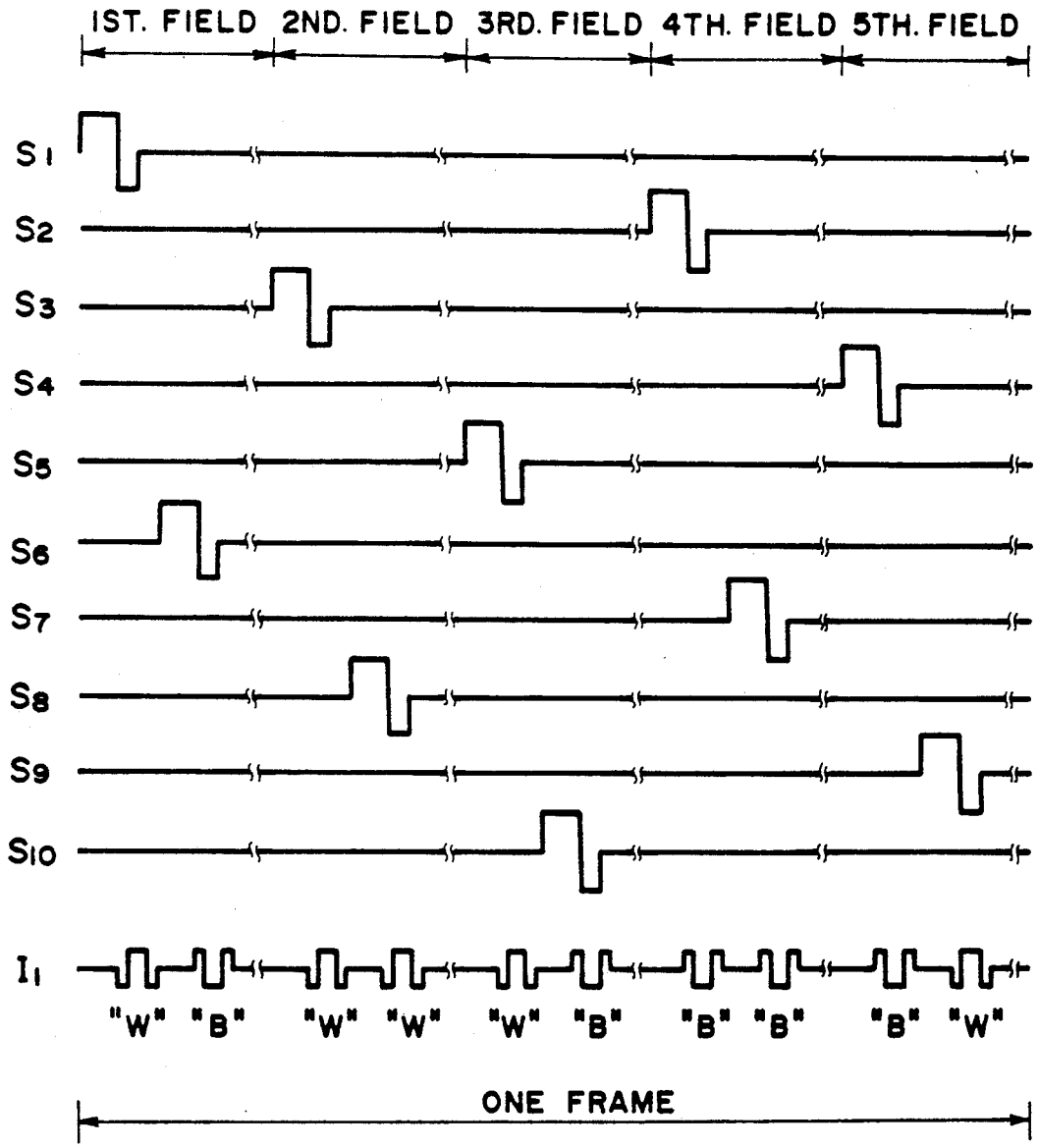

FIG. 4C is a time chart of voltage waveforms for providing a certain display state. According to the embodiment shown in FIG. 4C, a scanning selection signal is applied to the scanning electrodes with jumping of 4 lines apart in one field so as to complete one frame scanning in 5 fields. Also in this embodiment, non-adjacent scanning electrodes are supplied with a scanning selection signal in consecutive 5 times of field scanning.

The present invention is not restricted to the above-described embodiments but can be effected generally in such a manner that a scanning selection signal is applied to the scanning electrodes with jumping of one or more lines apart, preferably 4–20 lines apart. Further, in the present invention, the peak values of the voltages $V_1$, $-V_2$ and $\pm V_3$ may be set to satisfy the relation of $|V_1|=|-V_2|>|\pm V_3|$, and preferably $|V_1|=|-V_2|\pm 2|\pm V_3|$. Further, the pulse durations of these voltage signals may be set to generally 1 μsec–1 msec, preferably 10 μsec–100 μsec, and may preferably be set to be longer at a lower temperature and shorter at a higher temperature.

2. Partial Rewriting Drive

Partial rewriting may be performed by intermittent writing of the above-mentioned whole display area scanning by refreshing drive in the present invention. Accordingly, some operational relationships between partial scanning of scanning electrodes used in the partial rewriting drive and the whole display picture scanning are set forth hereinbelow.

(1) When a demand for rewriting a part of a display picture occurs during whole display picture scanning by a refreshing drive, the field scanning at the time of the occurrence is finished and then a partial scanning of scanning electrodes is performed.

(2) The partial rewriting drive by partial scanning of scanning electrodes is performed by a non-interlaced scanning mode.

(3) The maximum number of scanning lines for the partial scanning of scanning electrodes is set equal to the number of the total scanning lines constituting the whole display picture area (the number of scanning lines for one frame scanning). In other words, at a point of time when the number of scanning lines for partial scanning exceeds the number of scanning lines for the whole display picture scanning, the partial scanning of scanning lines is interrupted to resume the whole display picture scanning.

(4) When a partial scanning of scanning lines is terminated while the number of scanning lines for the partial scanning is fewer than the maximum number of scanning lines for the partial scanning defined in the above paragraph (3), the field scanning drive is resumed from a first scanning line for a field scanning which is subsequent to the field scanning effected immediately before the partial scanning of scanning lines.

(5) Image data rewriting for the VRAM (memory for image data storage) does not depend on the rewriting speed of the display panel.

(6) Image data transferred to the display panel during the whole display picture scanning are those at the time of being transferred.

Figure 5:
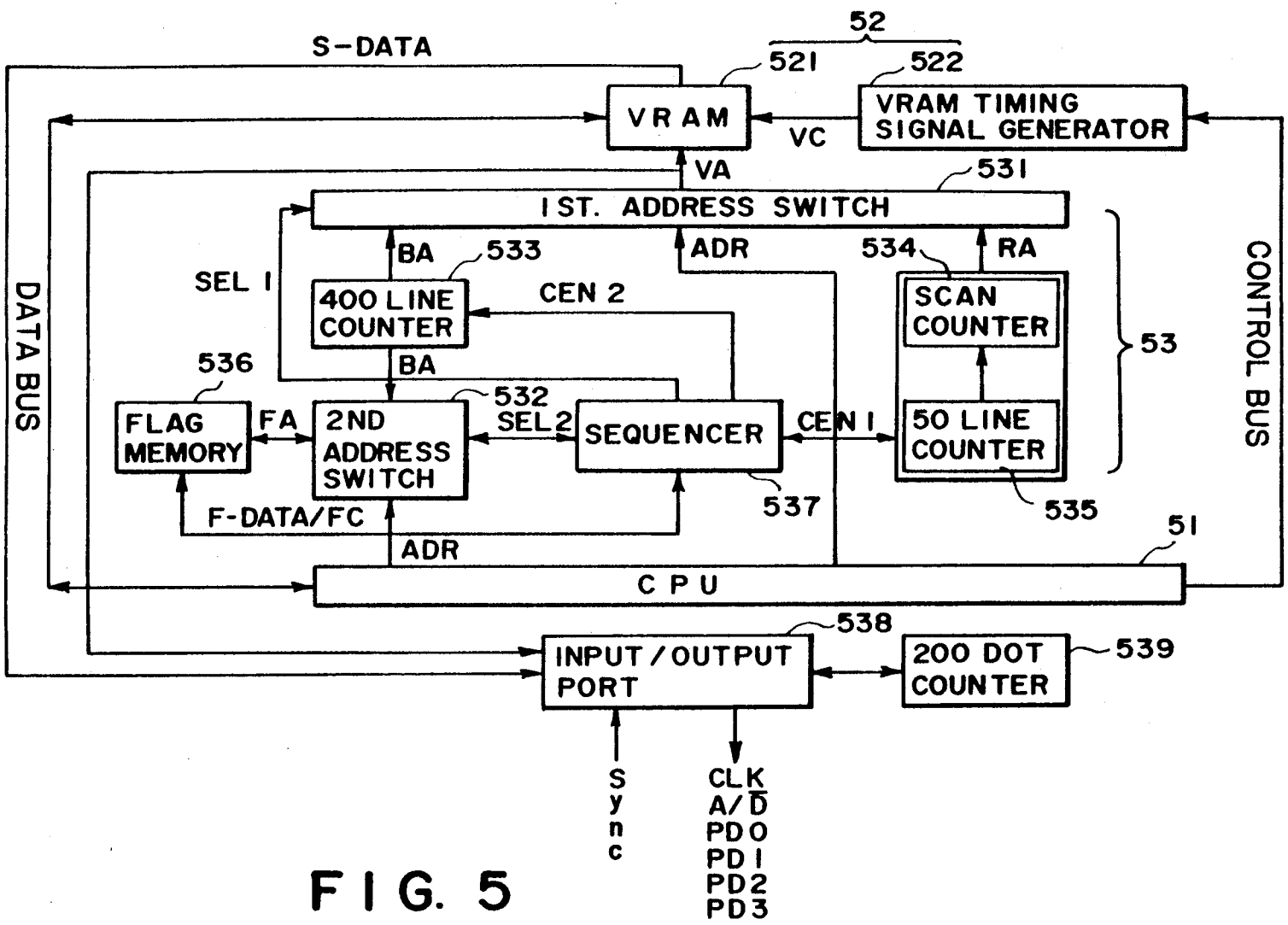
FIG. 5 is a block diagram of an apparatus body.

FIG. 5 shows a circuit structure for conducting a series of operations defined in the above paragraphs (1)–(6). More specifically, FIG. 5 shows a detailed structure of the apparatus body 14 shown in FIG. 1, which is functionally provided with a CPU unit 51, a VRAM unit 52 and a sequencer unit 53.

The CPU unit constitutes the control center of the apparatus body 14 and functions as the instruction source of image data generation.

The VRAM unit 52 comprises a VRAM 521 and a VRAM timing signal generator 522 and functions as a memory for storing image data.

The sequencer unit 53 comprises a first address switch 531, a second address switch 532, a 400-line counter 533, a scanning counter (8-line counter) 534, a 50-line counter 535, a flag memory 536, a sequencer 537, an input/output port 538, and a 800-dot counter 539. The sequencer unit 53 controls the access of the CPU unit 51 to the VRAM unit 52 and also the VRAM unit 52 with respect to image data transfer to the display panel 11.

A VA signal for access to an address in the VRAM 521 is an address signal selected from a BA signal, an ADR signal and an RA signal as follows:

(1) BA signal: A VRAM address signal for access to a partial rewriting drive of the display panel 11.

(2) ADR signal: A VRAM address signal at the time of image data generation from CPU 51.

(3) RA signal: A VRAM address signal for access to a whole display picture scanning drive of the display panel.

The above-mentioned BA signal, ADR signal and RA signal are subjected to selection by the first address switch 531 to be outputted as a VRAM address VA signal. The first address switch 531 is controlled by the sequencer circuit 537.

The scanning counter 534 is a counter for defining a scanning scheme and counts the number of scanning lines in jump-scanning for the refreshing drive. In this embodiment, the scanning lines are jump-scanned 7 lines apart.

The 50-line counter 535 defines the number of scanning lines in one field of the refreshing drive. In this embodiment, 400 scanning lines are jump-scanned 7 lines apart and are frame-scanned in 8 fields, so that 50 scanning lines are counted to make one field. The 400-line counter 533 counts a prescribed number of scanning lines (set to 400 lines in this embodiment) and functions as a frame counter in the whole display picture scanning. In the partial rewriting drive, the 400-line counter 533 generates scanning line address data for the partial scanning of scanning lines and causes an access to the VRAM address.

The second address switch 532 is a circuit for selecting either one of the BA signal and ADR signal for access (FA) to the flag memory 536. The two kinds of the flag memory address signals are selected by the sequencer circuit 537.

The flag memory 536 is a memory for allocating one bit of data for each scanning electrode. The one bit of data is hereinafter called a "flag". Flags are generated by writing an image data from the CPU 51 into the VRAM 521. VRAM address signals (ADR) generated at the time of rewriting by the CPU 51 into the VRAM 521 are sampled and converted into address signals (FA) each corresponding to one scanning electrode, based on which a flag of "0" or "1" is written in the flag memory 536. Thus, the location of scanning electrodes is detected based on the writing of image data by the CPU 51, and the detected data are written in the flag memory 536 as flags. Then, in the partial rewriting drive of the display panel 11, the flag data in the flat memory 536 and the BA signals from the 400-line counter 533 are compared, and the flag of "0" (="OFF") or "1" (="ON") is examined to designate only the scanning lines for the partial rewriting drive.

The 200-dot counter 539 is a circuit for counting the amount of image data to be transferred in one horizontal scanning and controlling the input/output port 538. In this embodiment, 800 dots of data are transferred in 4 bits (PD0, PD1, PD2, PD3), so that 200 (=800/4) counts is set.

The input/output port 538 transfers the image data PD0, PD1, PD2, PD3, CLK and A/D$^-$ comprising scanning electrode address data and image data to the control circuit 15 and receives the Sync signal from the control circuit.

Figure 6:
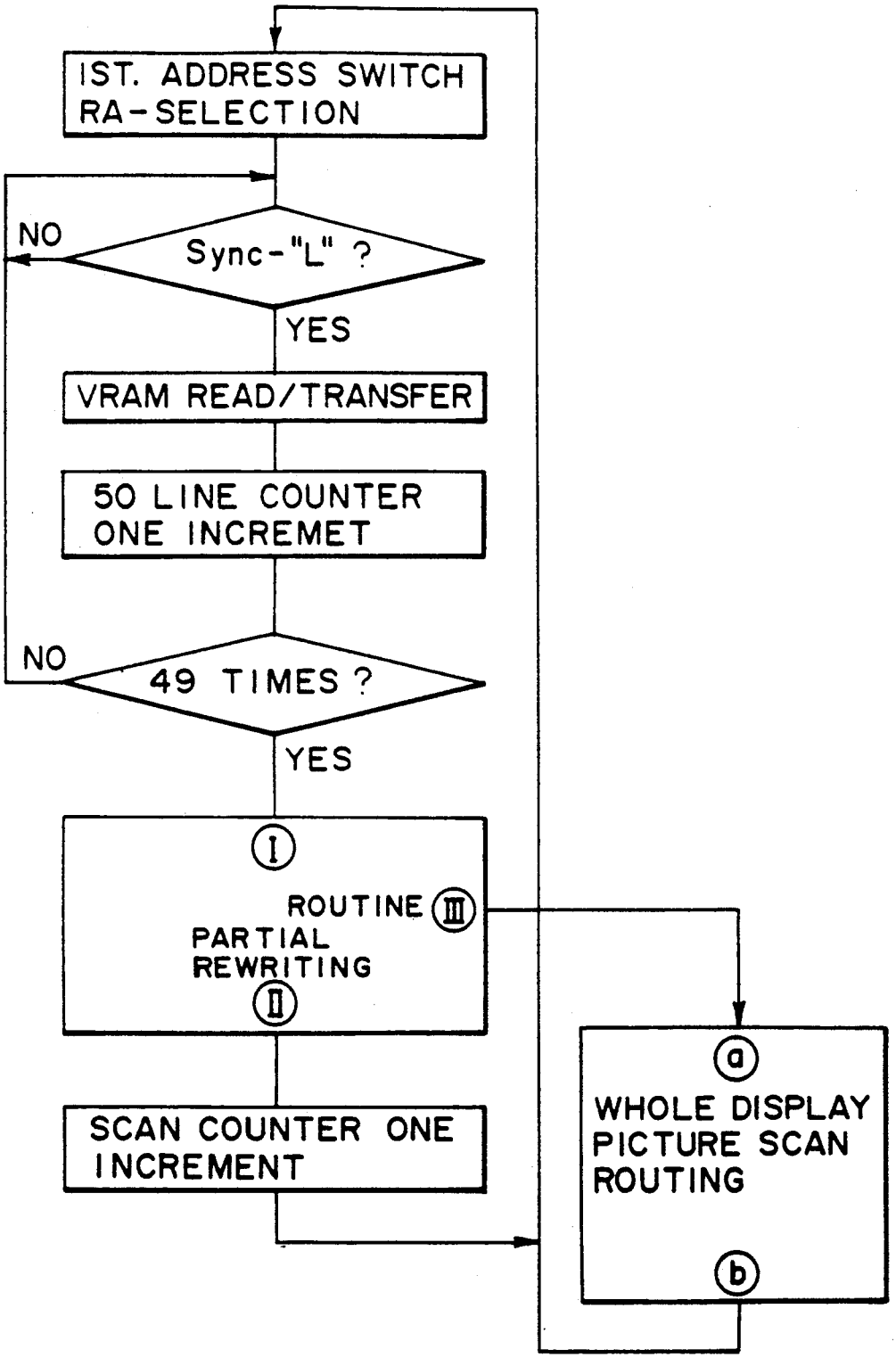
FIG. 6 is a flow chart showing an operation routine for whole display picture scanning drive and partial rewriting scanning drive.
Figure 7:
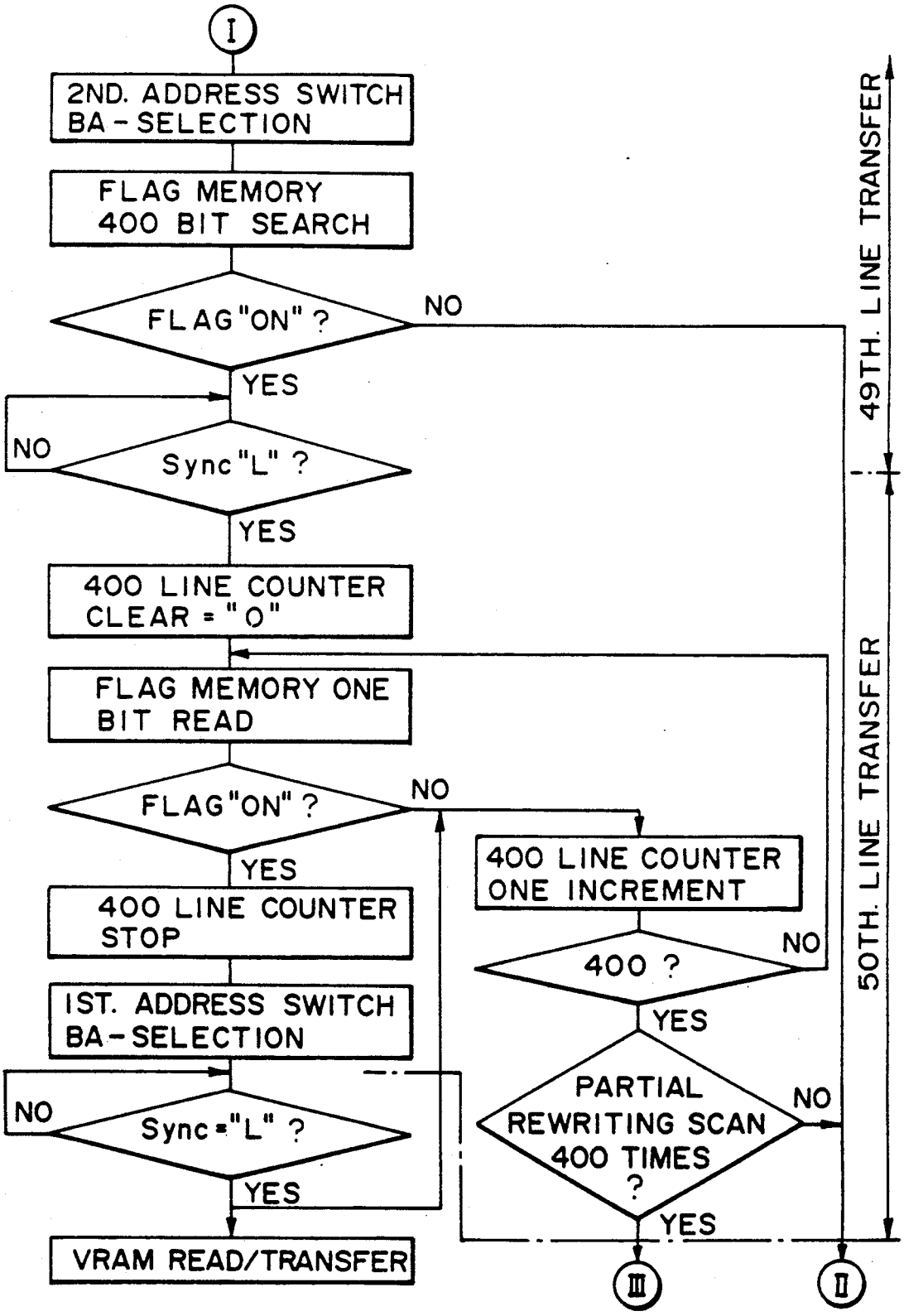
FIG. 7 is a flow chart showing an operation routine for partial rewriting scanning drive.
Figure 8:
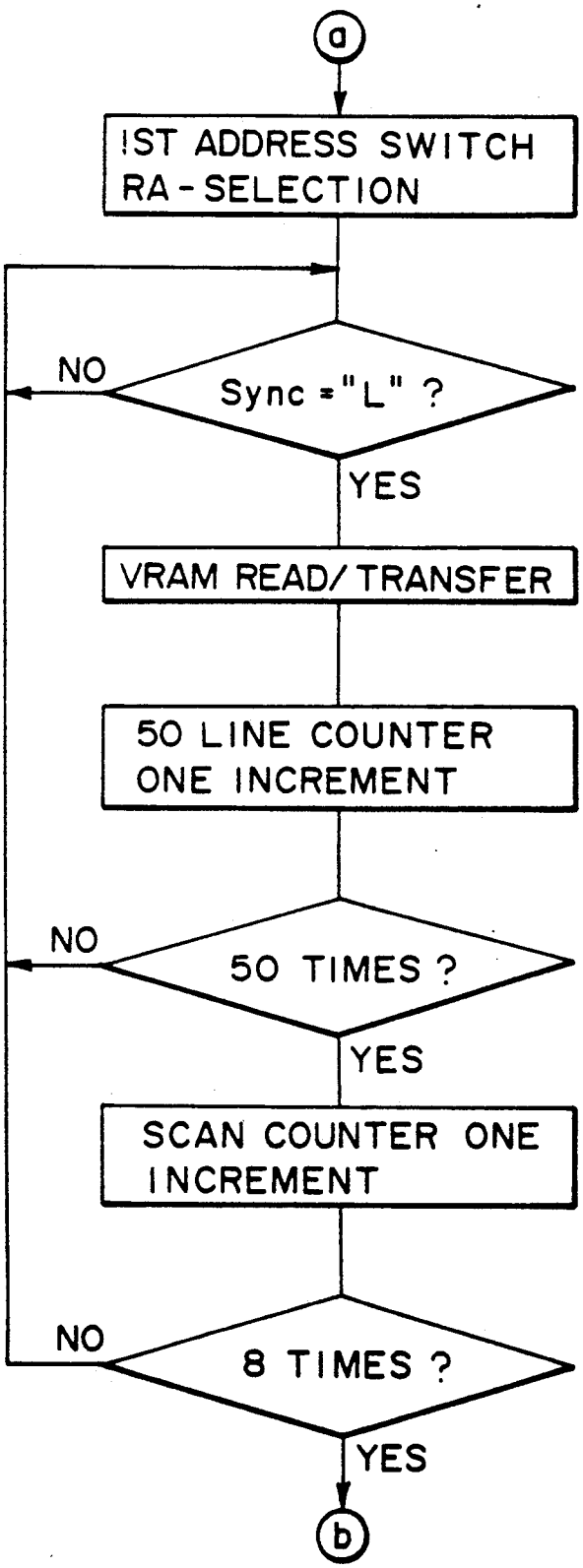
FIG. 8 is a flow chart showing one frame scanning drive.

C. Operational Relationship among the Display data Generation, Transfer Timing and Display Panel FIG. 6 is a flow chart showing the operational relationship between the whole display picture scanning drive and the partial rewriting scanning drive. FIG. 7 is a flow chart of the partial rewriting scanning drive. FIG. 8 is a flow chart of the whole display picture scanning drive.

Referring to FIGS. 5 and 6, first of all, as indicated by "1st ADDRESS SWITCH, RA SELECTION", a VRAM address signal (RA) from the scanning counter 534 which is a counter for the whole display picture scanning drive and the 50-line counter 535 is supplied to the VRAM 521 as a scanning electrode address data VA. Then, on receiving the "L" level of the Sync signal, the scanning electrode address data VA and image data in the VRAM designated by the VA signal are read out and transferred to the display panel 11. Then, one increment is given to the 50-line counter 535. If the count is 49 at the time of the increment, the partial rewriting routine is started, and if the count is not 49, the "L" level of the Sync signal is again awaited. Up to now, the operation of a so-called one-field scanning drive has been explained.

Then, when the count reaches 49, the partial rewriting routine is started and operated in the following manner.

A count of 49 means that the display data to be subsequently sent are for a 49th-scanning electrode in one field, whereby the partial rewriting routine is started from terminal (I) shown in FIG. 7. Further, even while the partial rewriting routine is operated, one field scanning drive is operated on the display panel, so that the time relation between the partial rewriting routine and the one-field scanning drive is shown by the notes of 49th LINE TRANSFER and 50th LINE TRANSFER in FIG. 7. The transfer in the 49th LINE TRANSFER and 50th LINE TRANSFER refers to transfer of scanning electrode address data and image data from VRAM 521 in the one-field scanning drive.

As shown by "2nd ADDRESS SWITCH, BA-SELECTION", a flag memory address signal (FA) from the 400-line counter 533 is supplied to the flag memory 536, and according to 400 times of counting, 400 bits of data in the flag memory 536 are read out. If a data with a flat "1" (="ON") is present among the data thus read out, the partial rewriting routine is started thereafter. If the flag is "0" (="OFF"), the operation proceeds to a terminal (II), i.e., returns to the whole display picture scanning drive. After the completion of the partial rewriting routine, one increment is given to the scanning counter 534, and another RA signal is set to again perform a one-field scanning drive.

Herein, the flag "1" means that rewriting is caused on a scanning electrode shown by a flat memory address (FA). In contrast thereto, no rewriting is indicated by the flag "0". The operation from the terminal (I) up to now is performed during the 49th-line transfer.

Then, the operation in case where a bit with a flag "1" is present, will now be explained. When the 50th line transfer is started on receiving Sync="L", the 400-line counter is first cleared (into "0"), one bit is read out from the flag memory 536. The readout is effected from the first scanning electrode. Here, again the flag memory is checked to determine whether it is "1" or "0". If "0", one increment is given to the 400-line counter, and another address signal (FA) is set for a subsequent 1-bit readout. At this time, when the count does not reach 400 as a result of the increment, one bit is read out from the flag memory 536. The operation up to now is repeated until a bit with a flag "1" is encountered.

When a bit with a flag "1" is read out, the operation of the 400-line counter 533 is interrupted, and the address of the flag "1" bit is retained. Under the condition of the operation of the 400-line counter 533 being interrupted, the completion of one field scanning drive is waited for by awaiting a Sync signal at "L" level.

On the other hand, the first address switch 531 is set to the position of BA-selection, and subsequent to the one-field scanning drive, the flag address held by the flag memory 536 is made the scanning electrode address for the partial rewriting scanning and image data in VRAM designated by the scanning electrode address are transferred. Further, simultaneously with the transfer, the above-mentioned operation after "400-LINE COUNTER ONE INCREMENT" is performed.

The above operation with a flag "1" bit is repeated 400 times. Then, at the 400 times of repetition, i.e., after evaluating the value due to the increment, and then it is judged whether the 400 is given by the number of scanning for the partial rewriting scanning. When 400 is not reached, the operation goes to a terminal (II) to return to the partial rewriting routine, and when 400 is reached, the operation goes to a terminal (III) so as to proceed to the whole display picture scanning routine.

Next, the operation in the whole display picture scanning is explained.

Referring to FIG. 8, the operation is started from a terminal (a), and the RA signal is selected by the first address switch 531. Then, a Sync signal at "L" level is awaited, and when it is satisfied, the scanning electrode address data defined by the scanning counter 534 and the 50-line counter 535 and image data designated thereby in VRAM are transferred. Then, one increment is given to the 50-line counter 535. Then, the count given by the increment is judged to be whether it has reached 50, and if it is not 50, a subsequent transfer is performed. If the counter is 50, the one-field scanning drive is judged to be completed and one increment is given to the scanning counter 534 to set a next field. Then, the count in the counter 534 is judged whether it has reached 8. If it is not 8, another one-field scanning drive is started from the beginning of the next field. If the count in the scanning counter 534 is 8, one frame scanning comprising 8-field scanning drives is judged to be completed, and the operation proceeds to a terminal (b). Then, the whole display picture scanning routine and the partial rewriting routine are repeated as shown in FIG. 6.

The above operation corresponds to the driving of the display panel as follows. Thus, while the display panel is not rewritten, the whole display picture scanning drive is always repeated. Search for image rewriting is effected for each one-field scanning drive. In case of rewriting, partial rewriting is performed after the completion of one-field scanning drive. The scanning drive in the partial rewriting is performed according to a non-interlaced mode. When the number of partial rewriting exceeds 400 times before a subsequent one-field scanning, the system is automatically moved to one-field scanning drive according to an interlaced scanning mode. The display panel 11 is subjected to repetition of a series of operations as described above based on image data from the apparatus body.

As shown in FIGS. 6–8, while image data are generated, the BA signal and the RA signal are only temporarily selected by the first address switch 531, and otherwise the ADR signal from the CPU 51 is selected. In other words, the data in VRAM 521 are in a condition that the access thereto is always possible by the CPU 51.

Figure 9:
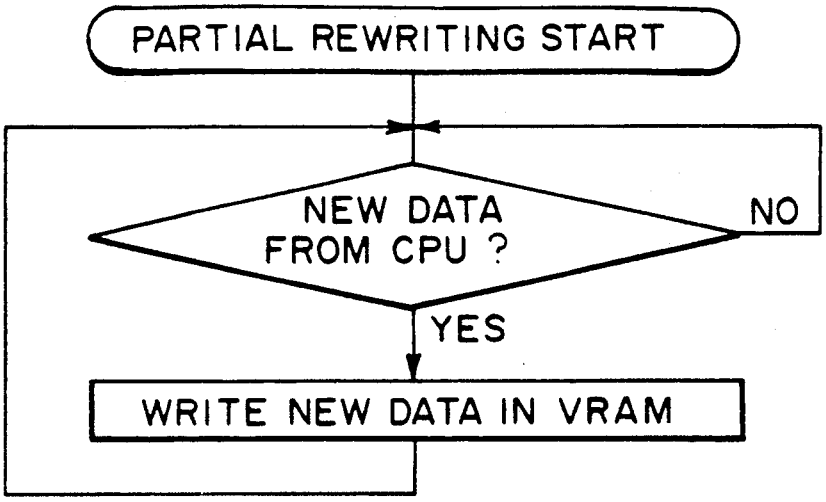
FIG. 9 is a flow chart showing a partial rewriting routine.
Figure 10:
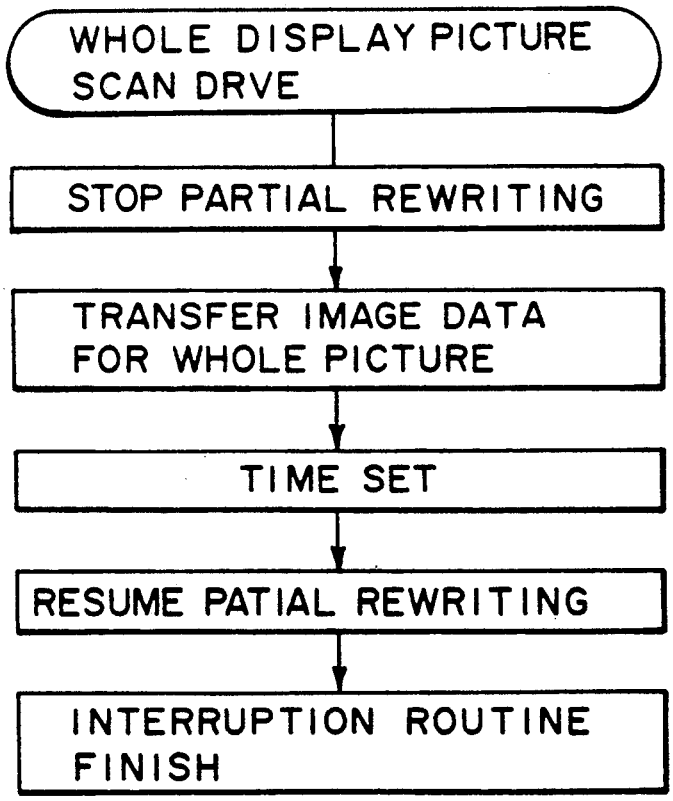
FIG. 10 is a whole display picture scanning drive routine.

FIG. 9 is a flow chart showing another partial rewriting routine used in the present invention, and FIG. 10 is a flow chart showing a display operation including the partial rewriting. In the operation, it is judged whether new data have came from the CPU, and if not, this operation is repeated. When new data appear, the previous data in the VRAM are rewritten. Thus, the apparatus body 14 adds scanning electrode address data to the image data from the CPU and transfers the sum to the control circuit 15.

On the other hand, the whole display scanning drive is executed at definite intervals. For this purpose, the main program is interrupted on demand for the whole display picture scanning drive, and the apparatus body 14 executes the routine shown in FIG. 10 at definite intervals according to the interruption demand. In the operation shown in FIG. 10, if the partial rewriting is under operation, it is interrupted to refuse new data from the CPU. Then, image data for the whole picture are transferred to the control circuit 15. Then, a time until the subsequent whole display picture scanning drive is set (to 1 second in this embodiment). Then, new data from the CPU are received.

The operation of the apparatus body 14 is defined in the above described manner to effect the driving method according to the present invention.

Figure 11A:
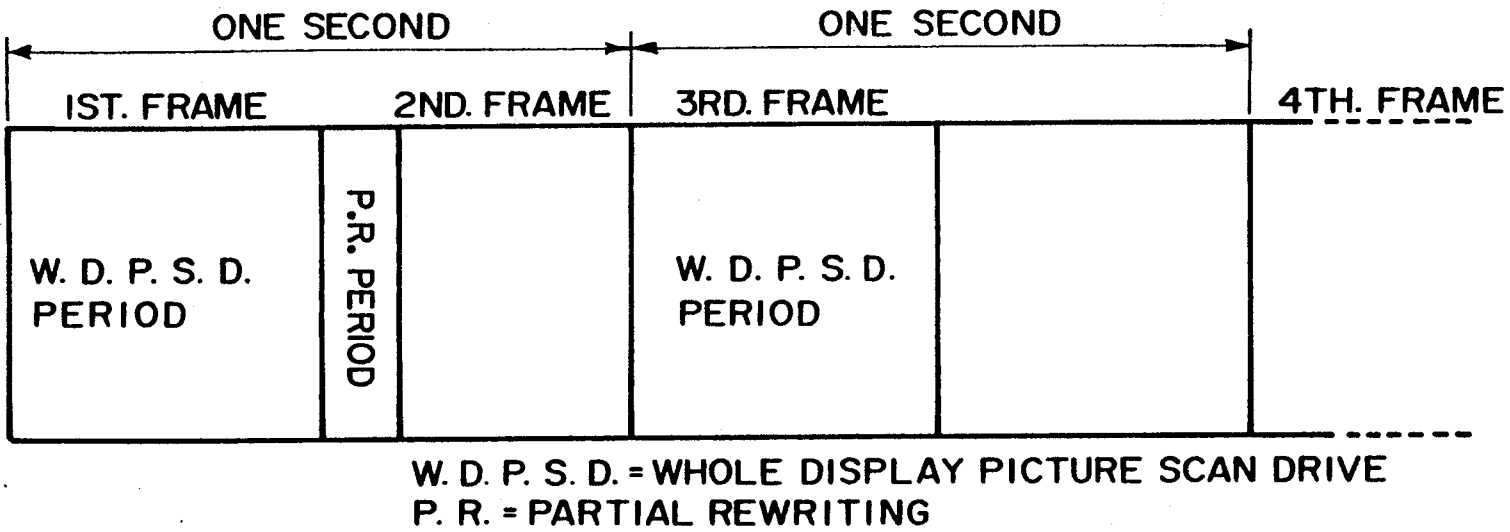
FIG. 11A is a time table for a case where the number of scanning electrodes for partial rewriting scanning < the number of whole picture scanning electrodes.
Figure 11B:
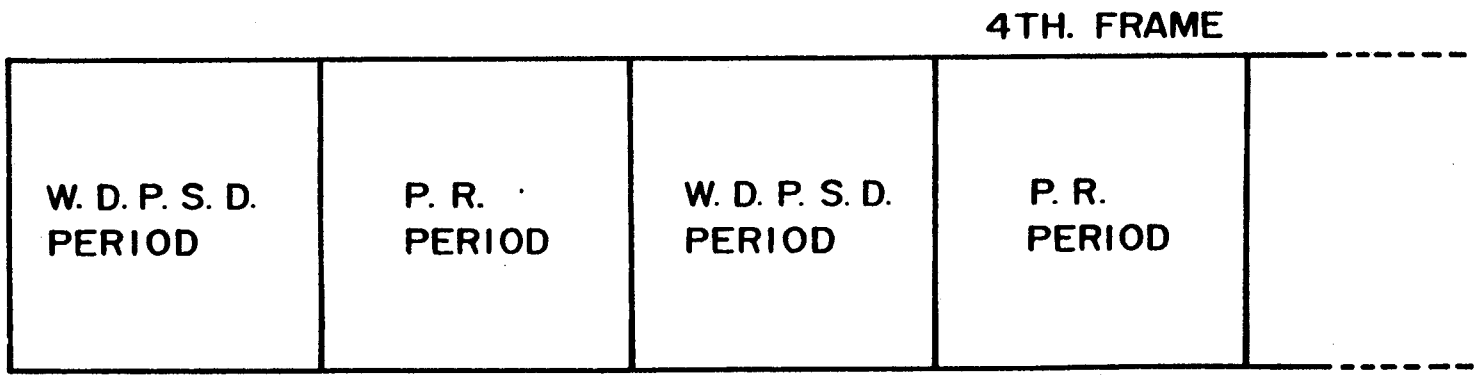
FIG. 11B is a time chart for a case where the number of scanning electrodes for partial rewriting scanning ≧ the number of whole picture scanning electrodes.

FIGS. 11A and 11B show time charts for showing the display operation principle according to the present invention, wherein the first frame is a period for the whole display picture scanning drive. If rewriting data are generated during this period, the apparatus body 14 prepares rewriting data (generates scanning electrode address data and image data serially) in the above described manner. Then, at the beginning of the second frame, the partial rewriting is started according to the routine shown in FIGS. 9 and 10. After the completion of the partial rewriting and on reaching a prescribed definite time, the whole display picture scanning drive is resumed.

Herein, if the rewriting data does not span the whole picture, i.e., in case of the number of scanning electrodes for the partial scanning < the number of scanning electrodes constituting the whole picture, the whole display picture scanning drive is started as soon as the partial rewriting is completed and a definite time is reached as shown in FIG. 11A.

On the other hand, in case the number of scanning for the partial rewriting ≧ the number of scanning electrodes constituting the whole picture (e.g., 400 lines), the partial rewriting is interrupted to proceed to the subsequent whole display picture scanning drive when the number of scanning for the partial rewriting exceeds 400. In this embodiment, the whole display picture scanning drive cycle has been set to 1 second.

D. Display Operation Example

Figure 12:
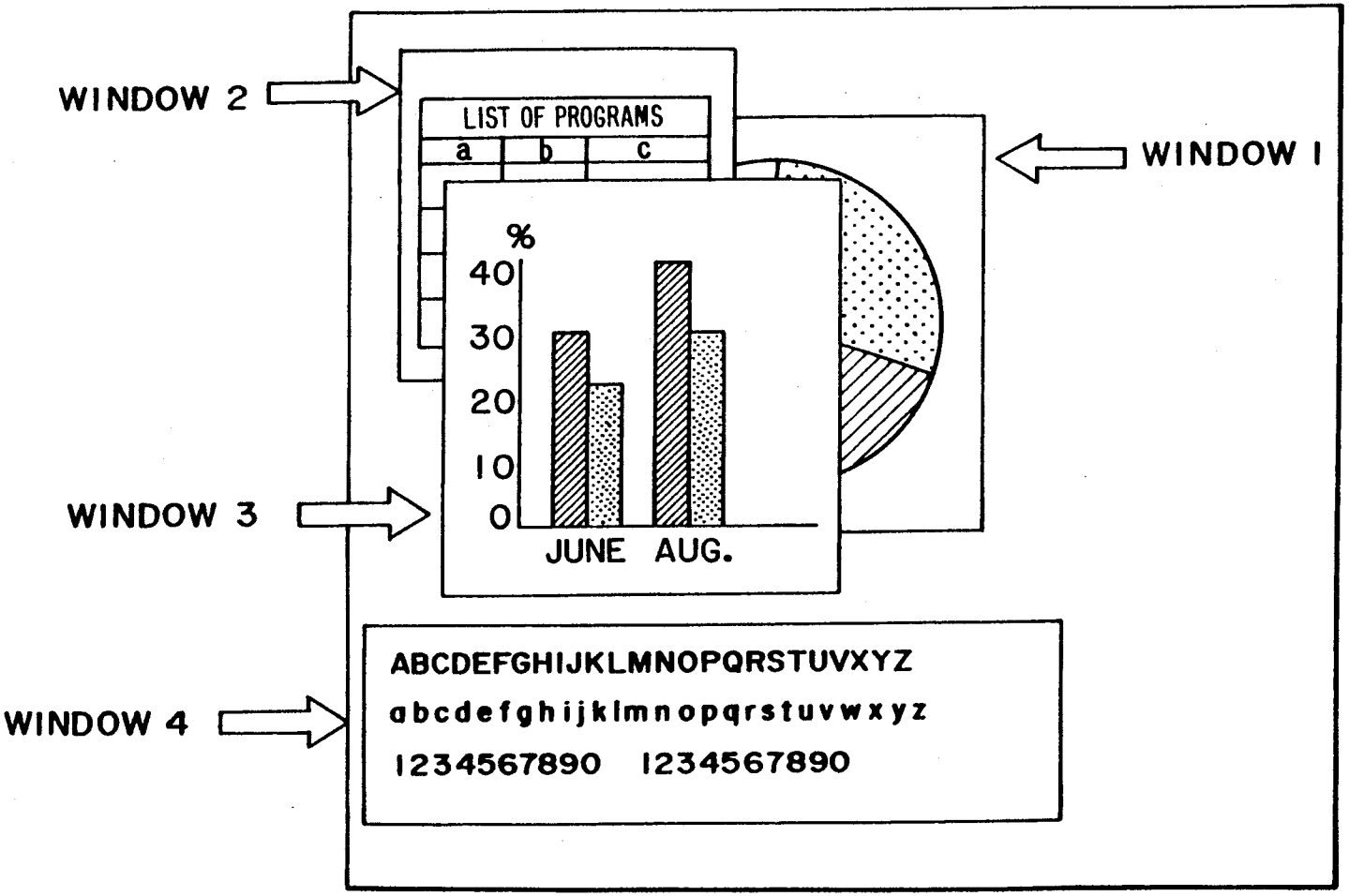
FIG. 12 is an illustration of an example of display image used in the invention.

FIG. 12 is an example of a multi-window picture display. The whole display picture comprises respectively different pictures in various display regions. A window 1 shows a picture of a categorized total result expressed in a circle. A window 2 shows the categorized total at the window 1 expressed in a table. A window 3 shows the categorized total at the window 1 expressed in a bar graph. A window 4 shows characters relating to formation of sentences. The background is formed in plain white.

Herein, the window 4 constitutes a picture in operation and the other pictures are in a still picture state. In other words, the window 4 is under preparation of a sentence and in a motion picture state. . The motion picture state may specifically include motions, such as scrolling; insertion, deletion and copying of words and paragraphs; and regional transfer. These motions generally require a quick movement. More specific display operation examples are given hereinbelow.

First example: one character is additionally displayed in an arbitrary row in the window 4.

A character font is assumed to be composed of 6×16 dots. The additional display of one character corresponds to rewriting of 16 scanning electrodes. According to the routine shown in FIGS. 5–8, only 16 scanning electrodes are rewritten as follows during the whole display picture scanning. First of all, search of the flag memory 536 is started from the 49th line in a field in which one character is additionally rewritten in VRAM 521 by CPU 51 and the search is continued until 16 bits of flags "ON" are detected to partially rewrite only 16 scanning electrodes after completing the field scanning drive under way. Then, a subsequent field scanning drive is sequentially effected from a leading scanning electrode. If one horizontal scanning time is assumed to be 250 μsec, the time required for rewriting 16 lines is 16×250 μsec=3.8 msec, so that a high-speed partial rewriting is performed. The time requires for one field scanning drive is 50×250 μsec=12.5 msec, so that the time required from the rewriting of VRAM 521 by CPU 51 until the actual display of the additional character is 16.3 msec at the maximum, which corresponds to about 61 Hz in terms of frequency and provides a very quick response. As a result, a partial scanning drive of scanning electrodes corresponding to a font given by a cursor or mouse may be repeated cyclically for different scanning electrodes to afford a moving display by such a cursor or mouse at a very high speed.

Second example: the whole picture area is scrolled according to the routine shown in FIGS. 5–8.

The timing for switching from the whole display picture scanning drive to the partial rewriting scanning drive is the same as in the above-mentioned first example. Herein, the partial rewriting is replaced by a whole display picture rewriting scanning, so that the number of scanning electrodes to be scanned for rewriting amounts to 400. Corresponding thereto, in a first one frame, 400 scanning electrodes are scanned by the non-interlaced scanning mode to rewrite the whole picture, and in a subsequently frame, the whole picture is scanned by the interlaced scanning mode. Thus, the display picture is rewritten alternately by the non-interlaced scanning mode and the interlaced scanning mode. Herein, image data transferred from VRAM comprise the newest image data even in the interlaced scanning mode. In this example, if one horizontal scanning time is assumed to be 250 μsec, the time required for rewriting one whole picture is 400×250 μsec=100 msec, which corresponds to a frame frequency of 10 Hz and provides a visually recognizable level of scrolling.

Third example: a window 4 is subjected to smooth scrolling according to the routine shown in FIGS. 9–11.

It is assumed that the window 4 occupies 200 scanning electrodes. The smooth scrolling display corresponds to rewriting of 200 scanning electrodes. The driving of 200 scanning electrodes during the whole display picture scanning drive is effected as shown in FIG. 11. In the first frame, the whole display picture scanning drive is performed, and the partial driving of 200 scanning electrodes in 200×250 μsec=50 msec is performed from the beginning of the second frame and repeated until the subsequent time for initiation of the whole display picture scanning drive.

E. Ferroelectric Liquid Crystal Device

Figure 13:
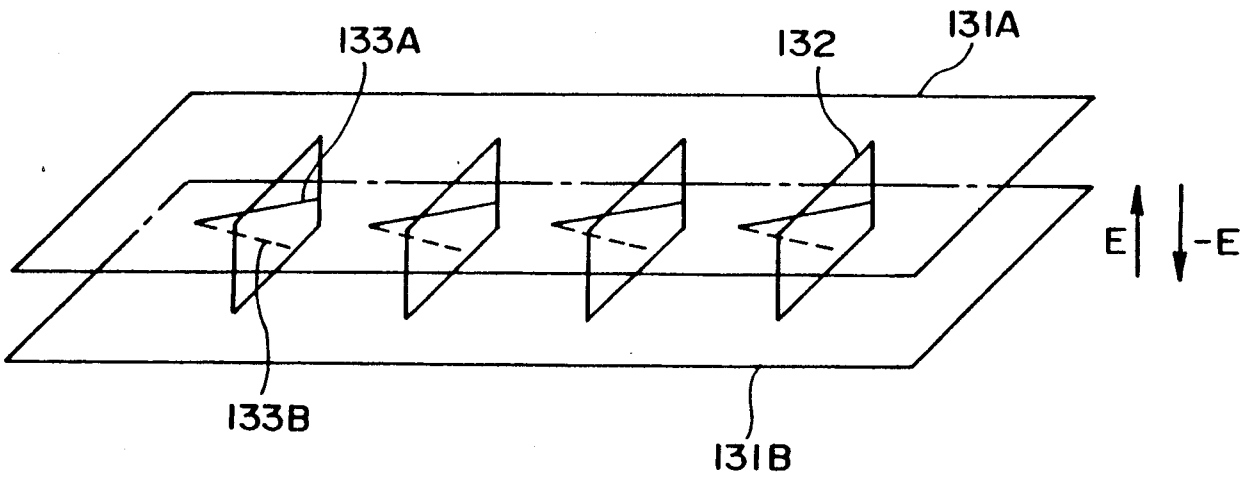
FIG. 13 is a schematic perspective view for illustrating a ferroelectric liquid crystal device used in the invention.

FIG. 13 schematically illustrates an embodiment of a ferroelectric liquid crystal cell which comprises a pair of electrode plates (glass substrates coated with transparent electrodes) 131A and 131B and a layer of ferroelectric liquid crystal having molecular layers 132 disposed between and perpendicular to the electrode plates. The ferroelectric liquid crystal assumes a chiral smectic C phase or an H phase and is disposed in a thickness (e.g., 0.5–5 microns) thin enough to release the helical structure inherent to the chiral smectic phase.

When an electric field E (or −E) exceeding a certain threshold is applied between the upper and lower substrates 131A, 131B, liquid crystal molecules 133 are oriented to the electric field. A liquid crystal molecule has an elongated shape and shows a refractive anisotropy between the long axis and the short axis. Therefore, if the cell is sandwiched between a pair of cross nicol polarizers (not shown), there is provided a liquid crystal modulation device. When an electric field E exceeding a certain threshold is applied, a liquid crystal molecules 133 is oriented to a first orientation state 133A. Further, when a reverse electric field −E is applied, the liquid crystal molecule 133 is oriented to a second orientation state 133B to change its molecular direction. Further, the respective orientation states are retained as long as an electric field E or −E applied thereto does not exceed a certain threshold.

The ferroelectric liquid crystal device used in this embodiment has an inclination to be monostable so that the first stable state 133A and second stable state 133B are unsymmetrical. As a result, the liquid crystal molecules tend to be oriented to either one of the orientation states or to another stabler third orientation state. The present invention is suitably applied to such a ferroelectric liquid crystal device having an inclination to be monostable but can also be applied to a ferroelectric liquid crystal device in an alignment state showing semipermanent or permanent bistability as disclosed by U.S. Pat. No. 4,367,924 or a ferroelectric liquid crystal device in an alignment state retaining a helical structure.

Figure 14A:
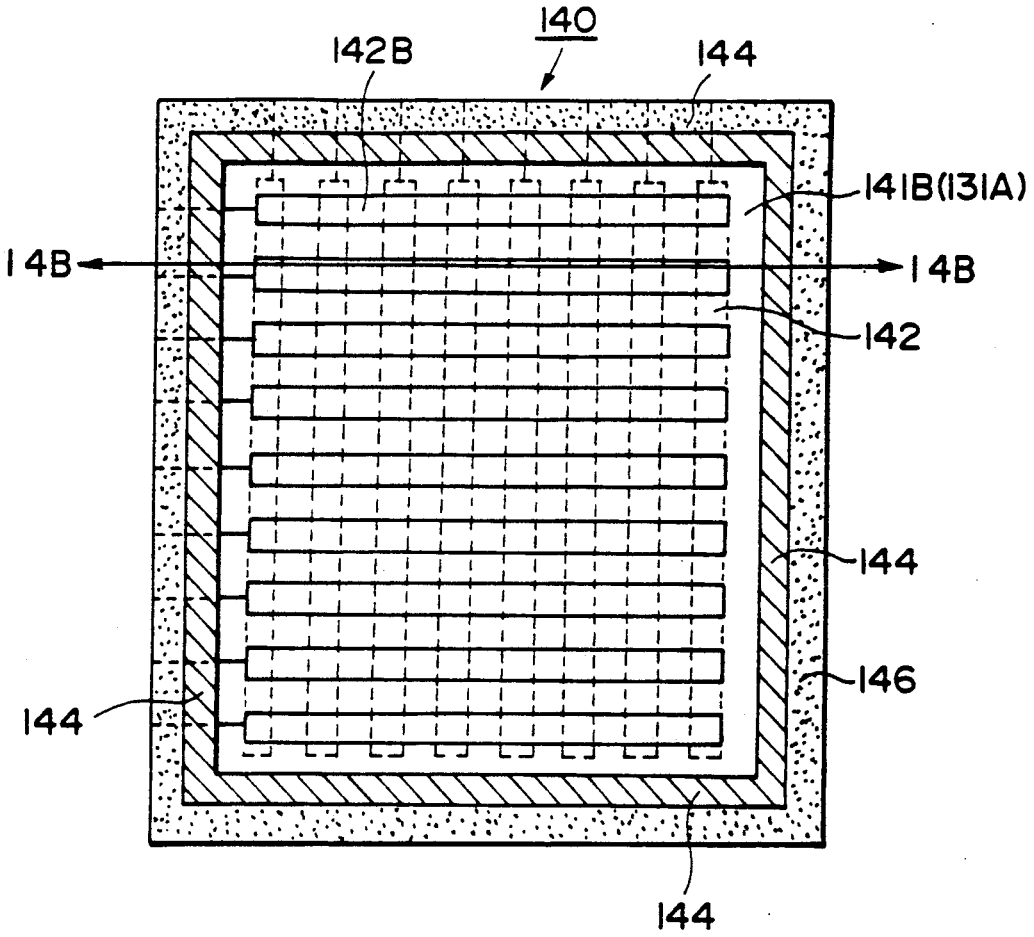
FIG. 14A is a plan view of a device used in the invention.
Figure 14B:
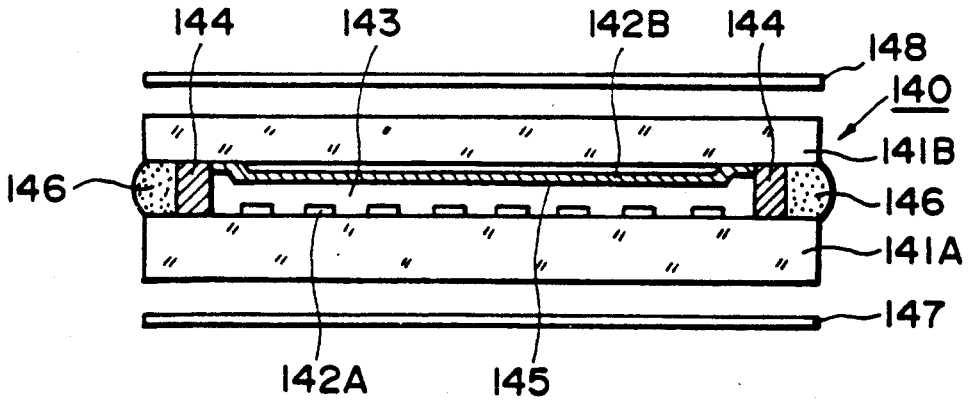
FIG. 14B is a sectional view taken along the line A—A in FIG. 14A.

FIG. 14A and 14B illustrate an embodiment of the liquid crystal device according to the present invention. FIG. 14A is a plan view of the embodiment and FIG. 14B is a sectional view taken along the line A—A in FIG. 14A.

A cell structure 140 shown in FIG. 14 comprises a pair of substrates 141A and 141B made of glass plates or plastic plates which are held with a predetermined gap with spacers 144 and sealed with an adhesive 146 to form a cell structure. On the substrate 141A is further formed an electrode group (e.g., an electrode group for applying scanning voltages of a matrix electrode structure) comprising a plurality of transparent electrodes 142A in a predetermined pattern, e.g., of a stripe pattern. On the substrate 141B is formed another electrode group (e.g., an electrode group for applying signal voltages of the matrix electrode structure) comprising a plurality of transparent electrodes 142B intersecting with the transparent electrodes 142A.

On the substrate 141B provided with such transparent electrodes 142B may be further formed an alignment control film 145 composed of an inorganic insulating material such as silicon monoxide, silicon dioxide, aluminum oxide, zirconia, magnesium fluoride, cerium oxide, cerium fluoride, silicon nitride, silicon carbide, and boron nitride, or an organic insulating material such as polyvinyl alcohol, polyimide, polyamide-imide, polyester-imide, polyparaxylylene, polyester, polycarbonate, polyvinyl acetal, polyvinyl chloride, polyamide, polystyrene, cellulose resin, melamine resin, urea resin and acrylic resin.

The alignment control film 145 may be formed by first forming a film of an inorganic insulating material or an organic insulating material as described above and then rubbing the surface thereof in one direction with velvet, cloth, paper, etc.

In another preferred embodiment according to the present invention, the alignment control film 145 may be formed as a film of an inorganic insulating material such as SiO or $SiO_2$ on the substrate 141B by the oblique or tilt vapor deposition.

In another embodiment, the surface of the substrate 141B of glass or plastic per se or a film of the above-mentioned inorganic material or organic material formed on the substrate 141B is subjected to oblique etching to provide the surface with an alignment control effect.

It is preferred that the alignment control film 145 also functions as an insulating film. For this purpose, the alignment control film may preferably have a thickness in the range of 100 Å to 1 micron, especially 500 to 5000 Å. The insulating film also has the function of preventing the occurrence of an electric current which is generally caused due to minor quantities of impurities contained in the liquid crystal layer 143, whereby deterioration of the liquid crystal compounds is prevented even on repeating operations.

As the ferroelectric liquid crystal 143, a liquid crystal compound or composition as disclosed in U.S. Pat. Nos. 4,561,726, 4,614,609, 4,589,996, 4,592,858, 4,596,667, 4,613,209, etc., may be used.

The device shown in FIGS. 14A and 14B further comprises polarizers 143 and 148 having polarizing axes crossing each other, preferably at 90 degrees.

As described above, according to the present invention, a partial rewriting scanning drive and a whole display picture scanning drive are compatibly realized, and further, a partial motion picture at a low frame frequency can be effected at a high speed while a still picture display is stably effected by using a ferroelectric liquid crystal material having a strong inclination of monostability.

What is claimed is:

1. A display system, comprising:

(a) a display panel having an electrode matrix comprising scanning lines and data lines;

(b) a display data storage memory for storing display data supplied from a display data input device; and (c) control means for, when display data supplied from the display data input device is moving display data, controlling the display data storage memory to store the moving display data and supply address data for designating only scanning lines corresponding to the moving display data so as to control the electrode matrix to scan only the scanning lines on which the moving display data is written.

2. A display system according to claim 1, wherein said display panel comprises a ferroelectric liquid crystal disposed between the scanning electrodes and data electrodes.

3. A display system, comprising:

(a) a display panel having an electrode matrix comprising scanning lines and data lines;

(b) a display data storage memory for storing display data supplied from a display data input device; and (c) control means for, when display data supplied form the display data storage memory is static image display data or scrolling display data and image data inputted to the display data storage memory is cursor or mouse display mark data, storing address data for designating only scanning lines corresponding to the cursor or mouse display mark data, transferring the stored address data and controlling the electrode matrix so as to scan only the scanning lines on which the moving display data is written.

4. A display system according to claim 3, wherein said display panel comprises a ferroelectric liquid crystal disposed between the scanning electrodes and data electrode.

* * * * *

UNITED STATES PATENT AND TRADEMARK OFFICE

CERTIFICATE OF CORRECTION

PATENT NO. : 5,172,107

DATED : December 15, 1992

INVENTOR(S) : HIDEO KANNO, ET AL.

It is certified that error appears in the above-identified patent and that said Letters Patent is hereby corrected as shown below:

TITLE PAGE

IN [56] REFERENCES CITED

Under U.S. PATENT DOCUMENTS,
"4691,200 9/1987 Stephany ." should read
--4,691,200 9/1987 Stephany .--.

COLUMN 1

Line 63, "1/4000" should read --1/400--.

COLUMN 2

Line 42, "monostability" should read --monostability loses--.

COLUMN 4

Line 61, "electrodes 13D" should read --electrodes 12C--.
Line 63, "electrode 12D" should read --electrodes 13D--.

COLUMN 8

Line 19, "$|V_1|=|-V_2|\pm 2|\pm V_3|$." should read
--$|V_1|=|-V_2|\geqq 2|\pm V_3|$.--.

UNITED STATES PATENT AND TRADEMARK OFFICE

CERTIFICATE OF CORRECTION

PATENT NO. : 5,172,107

DATED : December 15, 1992

INVENTOR(S) : HIDEO KANNO, ET AL.

It is certified that error appears in the above-indentified patent and that said Letters Patent is hereby corrected as shown below:

COLUMN 16

Line 43, "form" should read --from--.

Signed and Sealed this

Fourteenth Day of December, 1993

Bruce Lehman

*Attest:*

BRUCE LEHMAN

*Attesting Officer*

*Commissioner of Patents and Trademarks*